US009812823B2

(12) United States Patent
Kawakami et al.

(10) Patent No.: US 9,812,823 B2
(45) Date of Patent: Nov. 7, 2017

(54) CONNECTOR HAVING A SHIELD CASE AND A BODY

(71) Applicant: HOSIDEN CORPORATION, Yao-shi (JP)

(72) Inventors: Yuta Kawakami, Yao (JP); Takayuki Nagata, Yao (JP)

(73) Assignee: HOSIDEN CORPORATION, Yao-shi (JP)

( * ) Notice: Subject to any disclaimer, the term of this patent is extended or adjusted under 35 U.S.C. 154(b) by 0 days.

(21) Appl. No.: 15/091,921

(22) Filed: Apr. 6, 2016

(65) Prior Publication Data

US 2016/0315428 A1 Oct. 27, 2016

(30) Foreign Application Priority Data

Apr. 22, 2015 (JP) ..... 2015-087514

(51) Int. Cl.

| | |
|---|---|
| ***H01R 12/00*** | (2006.01) |
| ***H01R 24/44*** | (2011.01) |
| ***H01R 12/72*** | (2011.01) |
| ***H01R 13/6476*** | (2011.01) |
| ***H01R 13/6594*** | (2011.01) |
| ***H01R 24/50*** | (2011.01) |
| *H01R 103/00* | (2006.01) |

(52) U.S. Cl.

CPC ..... *H01R 24/44* (2013.01); *H01R 12/724* (2013.01); *H01R 13/6476* (2013.01); *H01R 13/6594* (2013.01); *H01R 24/50* (2013.01); *H01R 2103/00* (2013.01)

(58) Field of Classification Search

CPC ..... H01R 24/46; H01R 24/50
USPC ..... 439/63, 581, 582
See application file for complete search history.

(56) References Cited

U.S. PATENT DOCUMENTS

| | | | | |
|---|---|---|---|---|
| 7,137,825 | B2 * | 11/2006 | Myer | H01R 23/6873 439/579 |
| 9,124,047 | B2 * | 9/2015 | Kanda | H01R 13/6474 |
| 2013/0115787 | A1 | 5/2013 | Kanda | |

FOREIGN PATENT DOCUMENTS

| | | | |
|---|---|---|---|
| JP | 2007-035587 | A | 2/2007 |
| JP | 2008-84561 | A1 | 4/2008 |

OTHER PUBLICATIONS

Extended European Search Report dated Jul. 29, 2016 for the counterpart European patent application No. 16020100.0.

* cited by examiner

*Primary Examiner* — Phuong Dinh
(74) *Attorney, Agent, or Firm* — Kratz, Quintos & Hanson, LLP

(57) ABSTRACT

A connector including a shield case including a first shell and a second shell, a body housed in the shield case, and a terminal held by the body. The first shell includes a connecting portion of tuboid shape extending in a first direction, and a cover extending in the first direction contiguously from the connecting portion. The second shell is a separate member from the first shell and attached to the cover. The second shell and the cover constitute a composite tube extending in a second direction, which is orthogonal to the first direction, or in an oblique direction, which includes components of the first and second directions. The terminal includes a first portion, which extends in the first direction and is disposed inside the connecting portion, and a second portion, which extends in the second direction or the oblique direction and is disposed inside the composite tube.

22 Claims, 14 Drawing Sheets

CONNECTOR HAVING A SHIELD CASE AND A BODY

CROSS-REFERENCE TO RELATED APPLICATIONS

The present application claims priority under 35 U.S.C. §119 of Japanese Patent Application No. 2015-087514 filed on Apr. 22, 2015, the disclosure of which is expressly incorporated by reference herein in its entity.

BACKGROUND OF THE INVENTION

Technical Field

The invention relates to connectors.

Background Art

A conventional coaxial connector is described in Japanese Unexamined Patent Publication No. 2008-84561. The coaxial connector includes a terminal, a body, and a shield case. The terminal is a generally L-shaped metal plate including a first portion extending in a first direction and a second portion extending in a second direction orthogonal to the first direction. The body of an insulating resin holds a middle portion of the terminal. The body and the terminal are housed in the shield case.

The shield case has a connecting portion and a mounting portion. The connecting portion is a rectangular tube extending in the first direction and connectable to a mating connector. The mounting portion is a box having an open bottom and extending in the second direction contiguously from the connecting portion. The first portion of the terminal is housed in the connecting portion, and the second portion of the terminal is partially housed in the mounting portion.

SUMMARY OF INVENTION

If the shield case is formed by stamping a metal plate, it is difficult to match impedances between the first portion and the second portion of the terminal. This is because the mounting portion, which is designed such as to be contiguous with the connecting portion, must be formed in such a shape as to be contiguous with the connecting portion. Such a requirement restricts the design of the mounting portion while meeting the requirement of matched impedances between the first portion and the second portion of the terminal. In short, the above conventional coaxial connector has restrictions on design flexibility.

In view of the above circumstances, the invention is devised to provide a connector having a high degree of design flexibility.

A connector according to an aspect of the invention includes a shield case, a body, and a terminal. The shield case includes a first shell and a second shell. The first shell includes a connecting portion and a cover. The connecting portion is of tuboid shape extending in a first direction. The cover extends in the first direction contiguously from the connecting portion. The second shell is a separate member from the first shell and attached to the cover. The second shell and the cover constitute a composite tube extending in a second direction or an oblique direction. The second direction is orthogonal to the first direction. The oblique direction includes components of the first and second directions. The body has an insulating property and is housed in the shield case. The terminal is held by the body and housed in the shield case. The terminal includes a first portion and a second portion. The first portion extends in the first direction and is disposed inside the connecting portion. The second portion extends in the second direction or the oblique direction and is disposed inside the composite tube.

The connector of this aspect has a high degree of design flexibility for the following reason. As the second shell is a separate member from the first shell, the second shell is not restricted to such a shape as to be contiguous with the connecting portion of the first shell. In other words, the second shell can be formed separately from the connecting portion of the first shell, facilitating the design of the composite tube such as to provide matched impedances between the first portion of the terminal, which is disposed inside the connecting portion of the first shell, and the second portion of the terminal, which is disposed inside the composite tube.

The first portion of the terminal may be disposed inside the connecting portion such as to extend along a central axis of the connecting portion. Distances L1, L2, L3, and L4 may be set such as to provide matched impedances between the first portion and the second portion of the terminal. Here, the distance L1 may be a distance to one side in the second direction, from the first portion of the terminal to the connecting portion; the distance L2 may be a distance to the other side in the second direction, from the first portion of the terminal to the connecting portion; the distance L3 may be a distance to one side in the first direction, from the second portion of the terminal to the composite tube; and the distance L4 may be a distance to the other side in the first direction, from the second portion of the terminal to the composite tube. The connector of this aspect provides matched impedances between the first portion and the second portion of the terminal.

Distances L5, L6, L7, and L8 may be set such as to provide matched impedances between the first portion and the second portion of the terminal. Here, the distance L5 may be a distance to one side in a third direction, from the first portion of the terminal to the connecting portion; the distance L6 may be a distance to the other side in the third direction, from the first portion of the terminal to the connecting portion; the distance L7 may be a distance to the one side in the third direction, from the second portion of the terminal to the composite tube; and the distance L8 may be a distance to the other side in the third direction, from the second portion of the terminal to the composite tube. The third direction may be orthogonal to the first direction and the second direction. The connector of this aspect provides matched impedances between the first portion and the second portion of the terminal.

The cover of the first shell may have an engaging hole. The second shell may include an engaging piece and a main body. The engaging piece of the second shell may be configured to be engaged with the engaging hole. The main body of the second shell may be configured to block the engaging hole. The connector of this aspect provides a further arrangement for matching impedances between the first portion and the second portion of the terminal. More particularly, the cover of the first shell has the engaging hole to be used for attaching the second shell to the cover, but the engaging hole of the cover is blocked with the main body of the second shell. Therefore, the existence of the engaging hole produces little or no adverse effect on impedance matching between the first portion and the second portion of the terminal.

The composite tube may include a wall on one side in the first direction, a wall on the other side in the first direction, a wall on one side in the third direction, and a wall on the other side in the third direction.

The cover may include a first wall and a second wall. The first wall of the cover may constitute at least a part of the wall on the one side in the third direction of the composite tube and extend in the second direction or the oblique direction. The second wall of the cover may constitute at least a part of the wall on the other side in the third direction of the composite tube and extend in the second direction or the oblique direction. The second shell may include a first blocking portion and a second blocking portion. The first blocking portion may constitute the wall on the one side in the first direction of the composite tube and extend in the second direction or the oblique direction. The second blocking portion may constitute the wall on the other side in the first direction of the composite tube and extend in the second direction or the oblique direction.

The first wall of the cover may constitute, instead of at least a part of the wall on the one side in the third direction of the composite tube, at least a part of the wall on one side in the first direction of the composite tube. The second wall of the cover may constitute, instead of at least a part of the wall on the other side in the third direction of the composite tube, at least a part of the wall on the other side in the first direction of the composite tube. The first wall and the second wall of the cover of this aspect may extend in the second direction or the oblique direction. The first blocking portion may constitute, instead of the wall on the one side in the first direction of the composite tube, the wall on the one side in the third direction of the composite tube. The second blocking portion may constitute, instead of the wall on the other side in the first direction of the composite tube, the wall on the other side in the third direction of the composite tube. The first blocking portion and the second blocking portion of this aspect may extend in the second direction or the oblique direction.

Alternatively, the cover may include a first wall, a second wall, and a third wall. The first wall of the cover may constitute the wall on the one side in the third direction of the composite tube and extend in the second direction or the oblique direction. The second wall of the cover may constitute the wall on the other side in the third direction of the composite tube and extend in the second direction or the oblique direction. The third wall of the cover may constitute one of the walls on the one and other sides in the first direction of the composite tube and extend in the second direction or the oblique direction. The second shell may include a first blocking portion. The first blocking portion may constitute the other one of the walls on the one and other sides in the first direction of the composite tube and extend in the second direction or the oblique direction.

The first wall of the cover may constitute, instead of the wall on the one side in the third direction of the composite tube, the wall on the one side in the first direction of the composite tube. The second wall of the cover may constitute, instead of the wall on the other side in the third direction of the composite tube, the wall on the other side in the first direction of the composite tube. The third wall of the cover may constitute, instead of one of the walls on the one and other sides in the first direction of the composite tube, one of the walls on the one and other sides in the third direction of the composite tube. The first, second, and third walls of the cover of this aspect may extend in the second direction or the oblique direction. The first blocking portion may constitute, instead of the other one of the walls on the one and other sides in the first direction of the composite tube, the other one of the walls on the one and other sides in the third direction of the composite tube. The first blocking portion of this aspect may extend in the second direction or the oblique direction.

Alternatively, the second shell may include a first blocking portion, a second blocking portion, and a third blocking portion. The first blocking portion may constitute the wall on the one side in the third direction of the composite tube and extend in the second direction or the oblique direction. The second blocking portion may constitute the wall on the other side in the third direction of the composite tube and extend in the second direction or the oblique direction. The third blocking portion may constitute one of the walls on the one and other sides in the first direction of the composite tube and extend in the second direction or the oblique direction. The cover may include a first wall. The first wall of the cover may constitute the other one of the walls on the one and other sides in the first direction of the composite tube and extend in the second direction or the oblique direction.

The first blocking portion may constitute, instead of the wall on the one side in the third direction of the composite tube, the wall on the one side in the first direction of the composite tube. The second blocking portion may constitute, instead of the wall on the other side in the third direction of the composite tube, the wall on the other side in the first direction of the composite tube. The third blocking portion may constitute, instead of one of the walls on the one and other sides in the first direction of the composite tube, one of the walls on the one and other sides in the third direction of the composite tube. The first, second, and third blocking portions of this aspect may extend in the second direction or the oblique direction. The first wall of the cover may constitute, instead of the other one of the walls on the one and other sides in the first direction of the composite tube, the other one of the walls on the one and other sides in the third direction of the composite tube. The first wall of the cover of this aspect may extend in the second direction or the oblique direction.

Alternatively, the second shell may further include a first wall and a second wall. The first wall may join together the first blocking portion and the second blocking portion. The first wall of the second shell may be disposed inside or outside of the first wall of the cover. The second wall may join together the first blocking portion and the second blocking portion. The second wall of the second shell may be disposed inside or outside of the second wall of the cover. The first wall of the cover and the first wall of the second shell may constitute the wall on the one side in the third direction of the composite tube. The second wall of the cover and the second wall of the second shell may constitute the wall on the other side in the third direction of the composite tube. Alternatively, the first wall of the cover and the first wall of the second shell may constitute the wall on the one side in the first direction of the composite tube, and the second wall of the cover and the second wall of the second shell may constitute the wall on the other side in the first direction of the composite tube.

The connecting portion of the first shell may include a first portion and a second portion. The first portion of the connecting portion may be a portion on one side in the second direction of the connecting portion. The second portion of the connecting portion may be a portion on the other side in the second direction of the connecting portion. The cover may extend in the first direction contiguously from the first portion of the connecting portion. The first and second walls of the cover may be opposed to the second portion of the connecting portion, with interstices left between the first and second walls and the second portion.

The first blocking portion of the second shell may block the interstice between the second portion of the connecting portion and the first wall of the cover and the interstice between the second portion of the connecting portion and the second wall of the cover. The connector of this aspect provides a further arrangement for matching impedances between the first portion and the second portion of the terminal for the following reason. An interstice exists between the second portion of the connecting portion and the first wall of the cover, and an interstice exists between the second portion of the connecting portion and the second wall. However, these interstices are blocked with the first blocking portion of the second portion. Therefore, the existence of the interstices produces little or no adverse effect on impedance matching between the first portion and the second portion of the terminal.

The first blocking portion of the second shell may fit in between the second portion of the connecting portion and the first wall of the cover, and between the second portion of the connecting portion and the second wall of the cover. In the connector of this aspect, by fitting the first blocking portion in between the second portion of the connecting portion and the first wall of the cover, and between the second portion of the connecting portion and the second wall, the first blocking portion is fixed to the first shell. This can prevent the second shell from falling off the first shell.

The first blocking portion of the second shell may be fixed to the body. An example of fixing means is providing the body with a protruding portion between the interstices and providing the first blocking portion of the second shell with a generally U-shaped distal portion, so that the distal portion of the first blocking portion can hold the protruding portion of the body. Another example of the fixing means is providing the body with at least one slit communicating with the interstices, so that the first blocking portion of the second shell can engage with the slit in the body. In the connector having the first blocking portion of the second shell fixed to the body with any fixing means reduces possibility that the second shell will fall off the body.

The first wall of the second shell may be in surface contact with the first wall of the cover. The second wall of the second shell may be in surface contact with the second wall of the cover. The connector of this aspect has a composite tube of increased strength. This is because the first wall of second shell is in surface contact with the first wall of the cover, and because the second wall of the second shell is in surface contact with the second wall of the cover.

The first and second walls of the cover may be provided with a first engaging portion. The first and second walls of the second shell may be provided with a second engaging portion. The first engaging portion may be an engaging protrusion and the second engaging portion is an engaging recess or engaging hole, or alternatively the second engaging portions may be an engaging protrusion and the first engaging portions is an engaging recess or engaging hole. The engaging protrusion may be configured to engage with the engaging recess or engaging hole. In the connector of this aspect, engagement between the engaging protrusion and the engaging recesses or the engaging holes reduces the possibility that the second shell will fall off the body.

The first wall of the second shell may be in surface contact with the first wall of the cover from inside the first wall of the cover. The second wall of the second shell may be in surface contact with the second wall of the cover from inside the second wall of the cover. The first shell may further include a leg extending from the first wall of the first shell and a leg extending from the second wall of the first shell. The connector of this aspect has an improved pry resistance for the following reason. The legs extend from the first and second walls of the first shell. The first wall of the second shell is in surface contact with the first wall of the first shell from inside the first wall of the first shell. The second wall of the second shell is in surface contact with the second wall of the first shell from inside the second wall of the first shell. Accordingly, when the connector as connected to a mating connector is pried, the applied load will not be concentrated onto the first and second walls of the cover.

A connector according to another aspect of the invention includes a shield case, a body, and a terminal. The shield case includes a first shell and a second shell. The first shell includes a connecting portion and a coupling portion. The connecting portion is of tuboid shape extending in a first direction. The coupling portion extends in the first direction contiguously from the connecting portion. The second shell is a separate member from the first shell and attached to the coupling portion. The second shell is of tuboid shape extending in a second direction or an oblique direction. The second direction is orthogonal to the first direction. The oblique direction includes components of the first and second directions. The body has an insulating property and is housed in the shield case. The terminal is held by the body and housed in the shield case. The terminal includes a first portion and a second portion. The first portion extends in the first direction and is disposed inside the connecting portion. The second portion extends in the second direction or the oblique direction and is disposed inside the second shell.

The connector of this aspect has a high degree of design flexibility for the following reason. As the second shell is a separate member from the first shell, the second shell is not restricted to such a shape as to be contiguous with the connecting portion of the first shell. In other words, the second shell can be formed separately from the connecting portion of the first shell, facilitating the design of the connecting portion such as to provide matched impedances between the first portion of the terminal, which is disposed inside the connecting portion of the first shell, and the second portion of the terminal, which is disposed inside the connecting portion.

The first portion of the terminal may be disposed inside the connecting portion such as to extend along a central axis of the connecting portion. Distances L1, L2, L3', and L4' may be set such as to provide matched impedances between the first portion and the second portion of the terminal. Here, the distance L1 may be a distance to one side in the second direction, from the first portion of the terminal to the connecting portion; the distance L2 may be a distance to the other side in the second direction, from the first portion of the terminal to the connecting portion; the distance L3' may be a distance to one side in the first direction, from the second portion of the terminal to the second shell; and the distance L4' may be a distance to the other side in the first direction, from the second portion of the terminal to the second shell. The connector of this aspect provides a further arrangement for matching impedances between the first portion and the second portion of the terminal.

Distances L5, L6, L7', and L8' may be set such as to provide matched impedances between the first portion and the second portion of the terminal. Here, the distance L5 may be a distance to one side in the third direction, from the first portion of the terminal to the connecting portion; the distance L6 may be a distance to the other side in the third direction, from the first portion of the terminal to the connecting portion; the distance L7' may be a distance to the one side in the third direction, from the second portion of the terminal to the second shell; and the distance L8' may be a distance to the other side in the third direction, from the second portion of the terminal to the second shell. The third direction may be orthogonal to the first direction and the second direction. The third direction may preferably be orthogonal to the first direction and the second direction. The connector of this aspect provides a further arrangement for matching impedances of the first portion and the second portion of the terminal.

The coupling portion of the first shell may have an engaging hole. The second shell may include an engaging piece and a main body. The engaging piece of the second shell may be configured to be engaged with the engaging hole. The main body of the second shell may be configured to block the engaging hole. The connector of this aspect provides a still further arrangement for matching impedances of the first portion and the second portion of the terminal. More particularly, the coupling portion of the first shell has the engaging hole to be used for attaching the second shell to the coupling portion, but the engaging hole of the coupling portion is blocked with the main body of the second shell. Therefore, the existence of the engaging hole produces little or no adverse effect on impedance matching between the first portion and the second portion of the terminal.

The connector in any one of the above aspects may further include a case having an insulating property. The case may be configured to house the shield case and have an engaging hole. The engaging hole of the case may communicate with the engaging hole of the first shell. The engaging piece of the second shell may be engaged with the engaging hole of the first shell and the engaging hole of the case.

A shield case is fixed to the case typically by engaging an engaging piece, which is formed by cutting and raising a part of the shield case, with an engaging hole or recess in the case. The cut-and-raised portion of the shield case leaves an opening in the shield case, and such an opening produces an adverse effect on impedance matching between first and second portions of a terminal. However, the connector of the above aspect of the invention is configured such that the engaging piece of the second shell is engaged not only with the engaging hole of the first shell but also with the engaging hole of the case. Accordingly, the first shell and the second shell can be fixed to the case without cutting and raising a portion of the first or second shell to form an engaging piece, i.e. without leaving any unblocked openings. The lack of unblocked openings in the first or second shell contributes to matched impedances between the first portion and the second portion of the terminal.

Figure 1A:
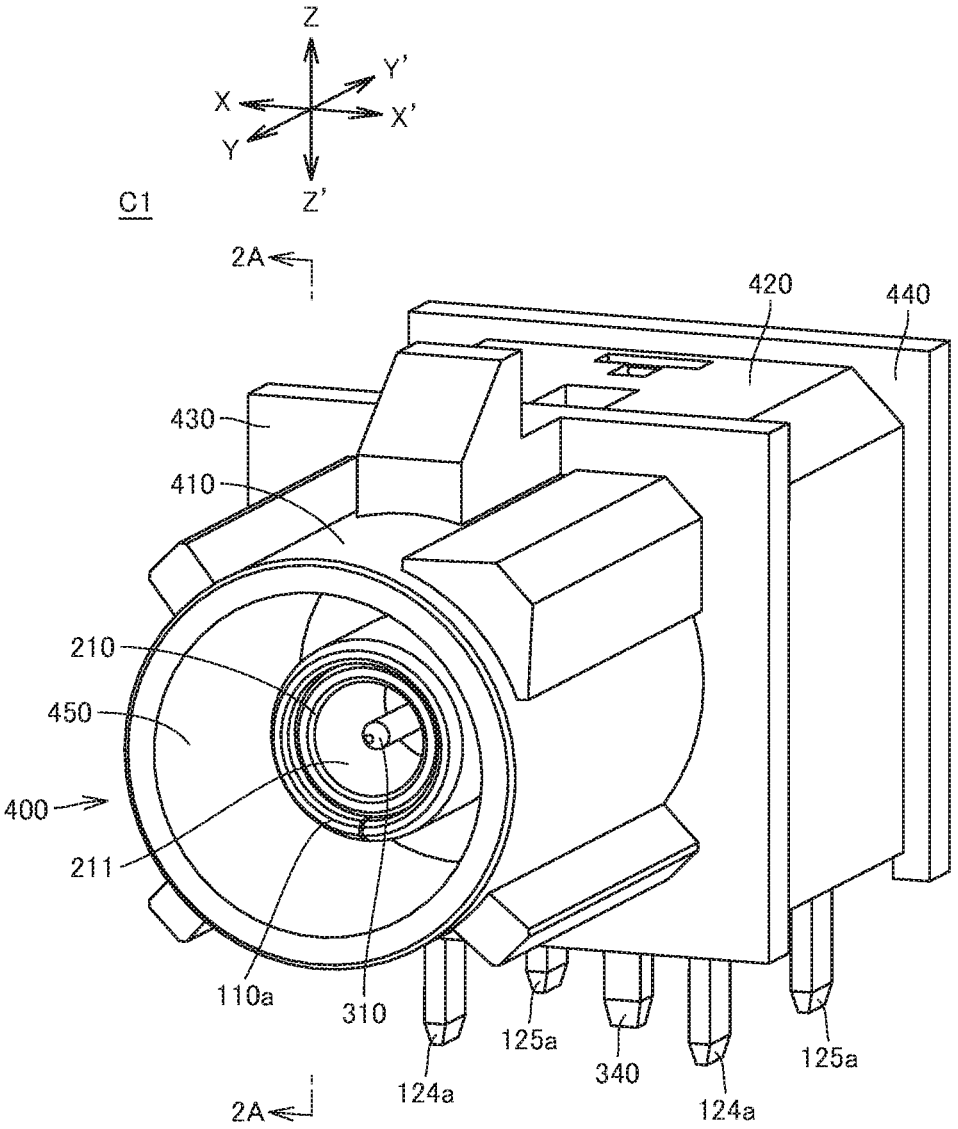
FIG. 1A is a front, top, left perspective view of a connector in accordance with the first embodiment of the invention.
Figure 1B:
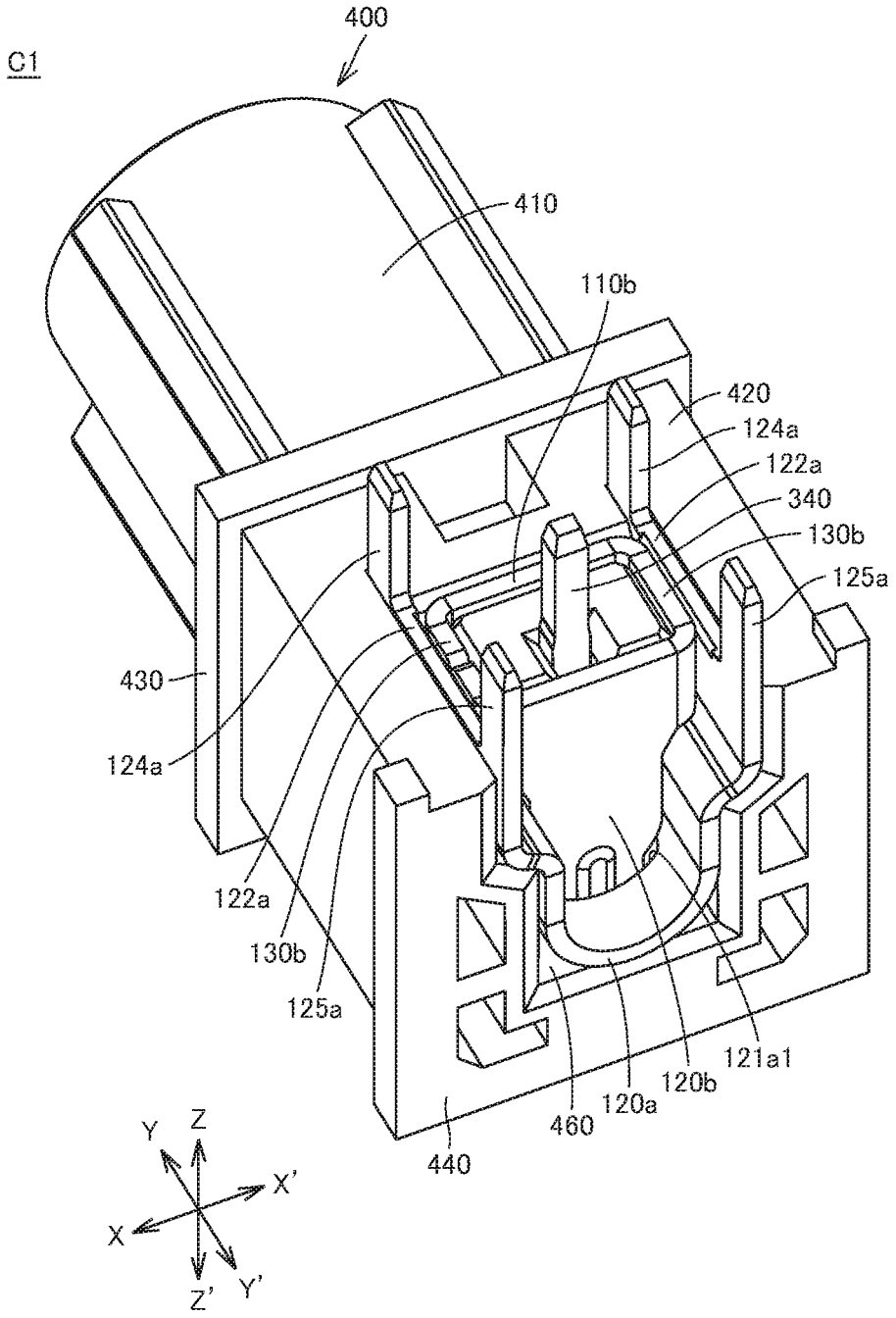
FIG. 1B is a back, bottom, right perspective view of the connector.

In the brief description of the drawings above and the description of embodiments which follows, relative spatial terms such as "upper", "lower", "top", "bottom", "left", "right", "front", "rear", etc., are used for the convenience of the skilled reader and refer to the orientation of the connector and its constituent parts as depicted in the drawings. No limitation is intended by use of these terms, either in use of the invention, during its manufacture, shipment, custody, or sale, or during assembly of its constituent parts or when incorporated into or combined with other apparatus.

DESCRIPTION OF EMBODIMENTS

First Embodiment

A connector C1 in accordance with the first embodiment of the invention will be described below with reference to FIG. 1A to FIG. 5B. The connector C1 includes a shield case 100, a body 200, a terminal 300, and a case 400. These constituents of the connector C1 will be described in detail. The Y-Y' direction indicated in FIG. 1A to FIG. 2A and FIG. 2E to FIG. 3B corresponds to the longitudinal direction of a connecting portion 110*a* (to be described) of the shield case 100 and will be referred to as a "first direction" in the claims. In the Y-Y' direction, the Y direction corresponds to one side in the first direction, and the Y' direction corresponds to the other side in the first direction. The Z-Z' direction indicated in FIG. 1A to FIG. 2A, FIG. 2D, FIG. 3A, and FIG. 3B corresponds a radial direction of the connecting portion 110*a* of the shield case 100 and will be referred to as a "second direction" in the claims. In the Z-Z' direction, the Z direction corresponds to one side in the second direction, and the Z' direction corresponds to the other side in the second direction. The Z-Z' direction is orthogonal to the Y-Y' direction. The X-X' direction indicated in FIG. 1A to FIG. 1B and FIG. 2B to FIG. 3B corresponds to another radial direction of the connecting portion 110*a* of the shield case 100 and will be referred to as a "third direction" in the claims. In the X-X' direction, the X direction corresponds to one side in the third direction, and the X' direction corresponds to the other side in the third direction. The X-X' direction is orthogonal to the Y-Y' direction and the Z-Z' direction.

Figure 2A:
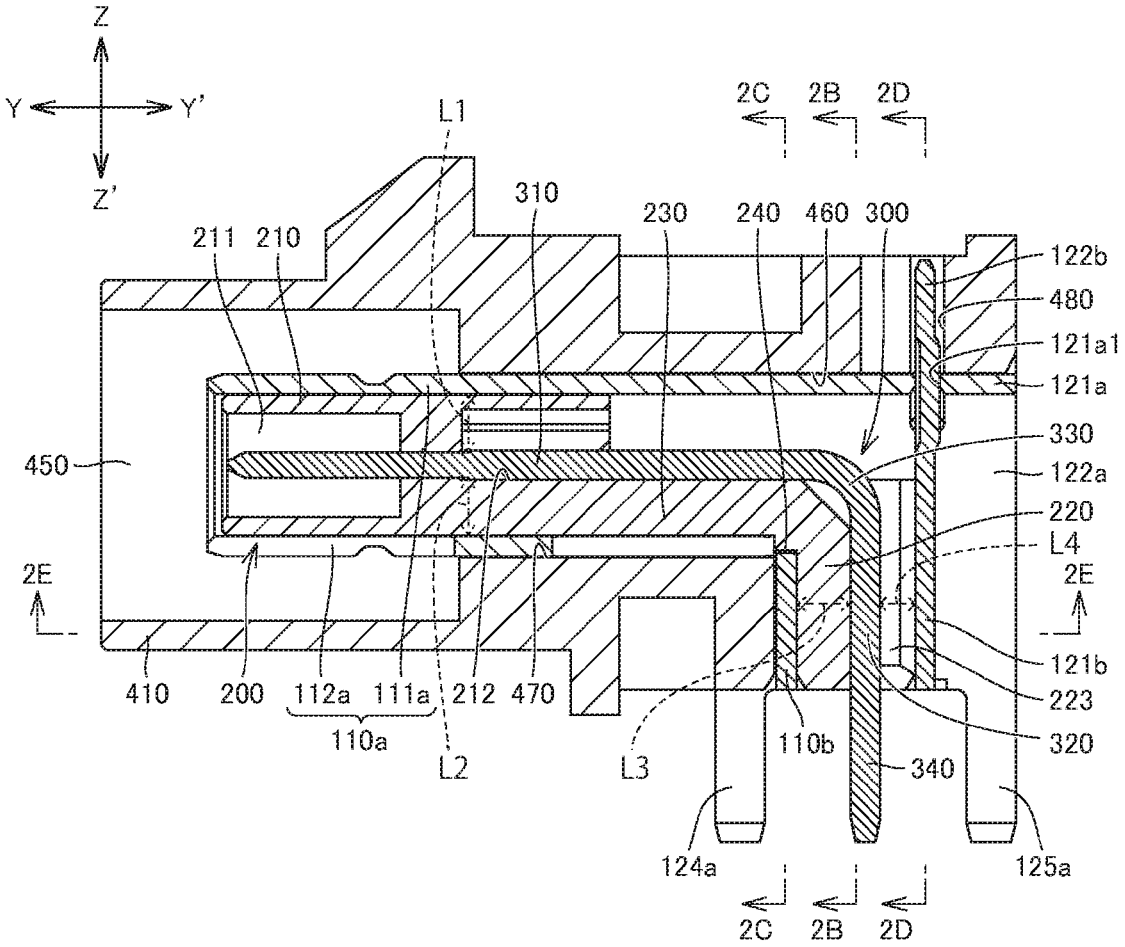
FIG. 2A is a sectional view of the connector, taken along 2A-2A in FIG. 1A.
Figure 3A:
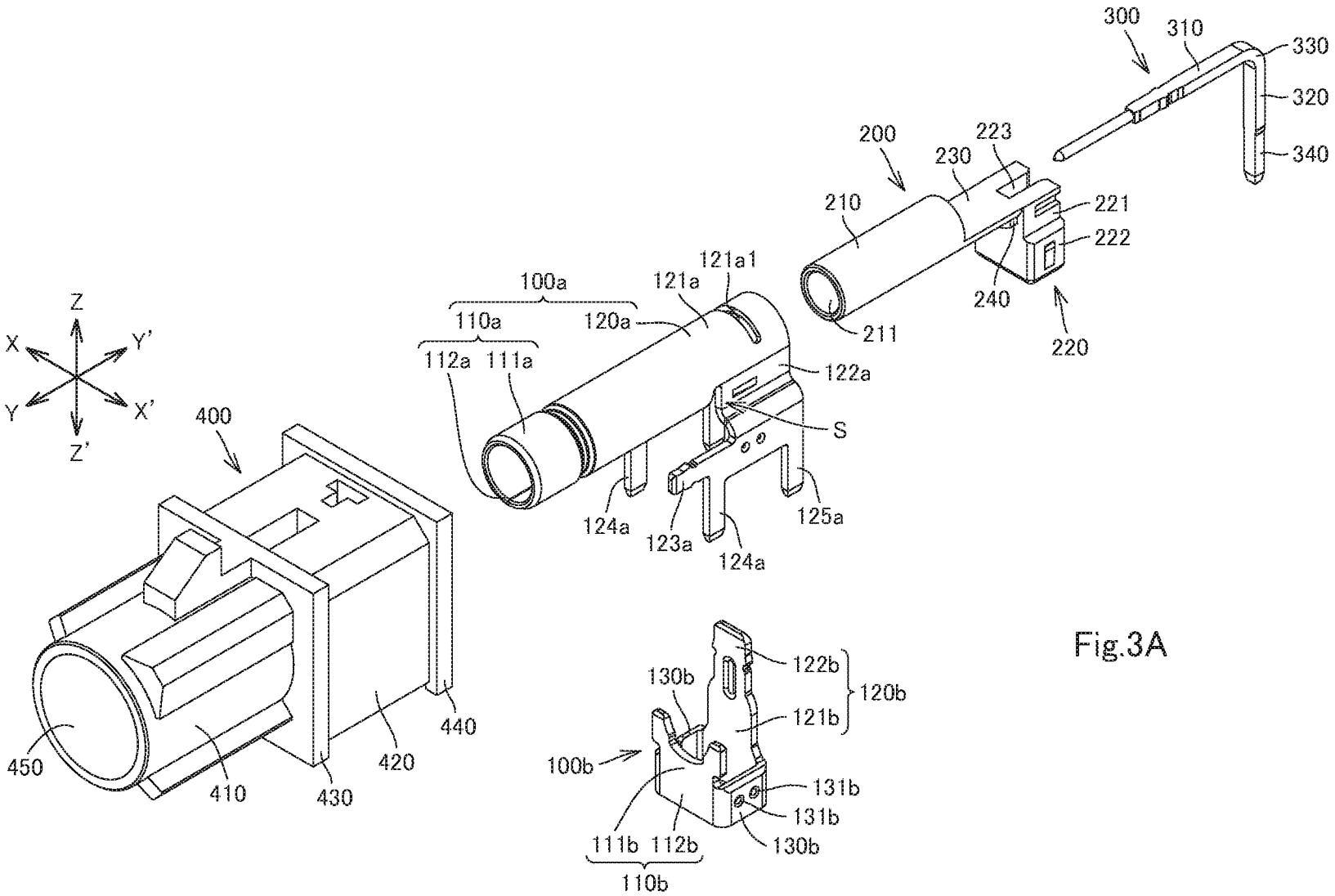
FIG. 3A is a front, top, left perspective exploded view of the connector.
Figure 3B:
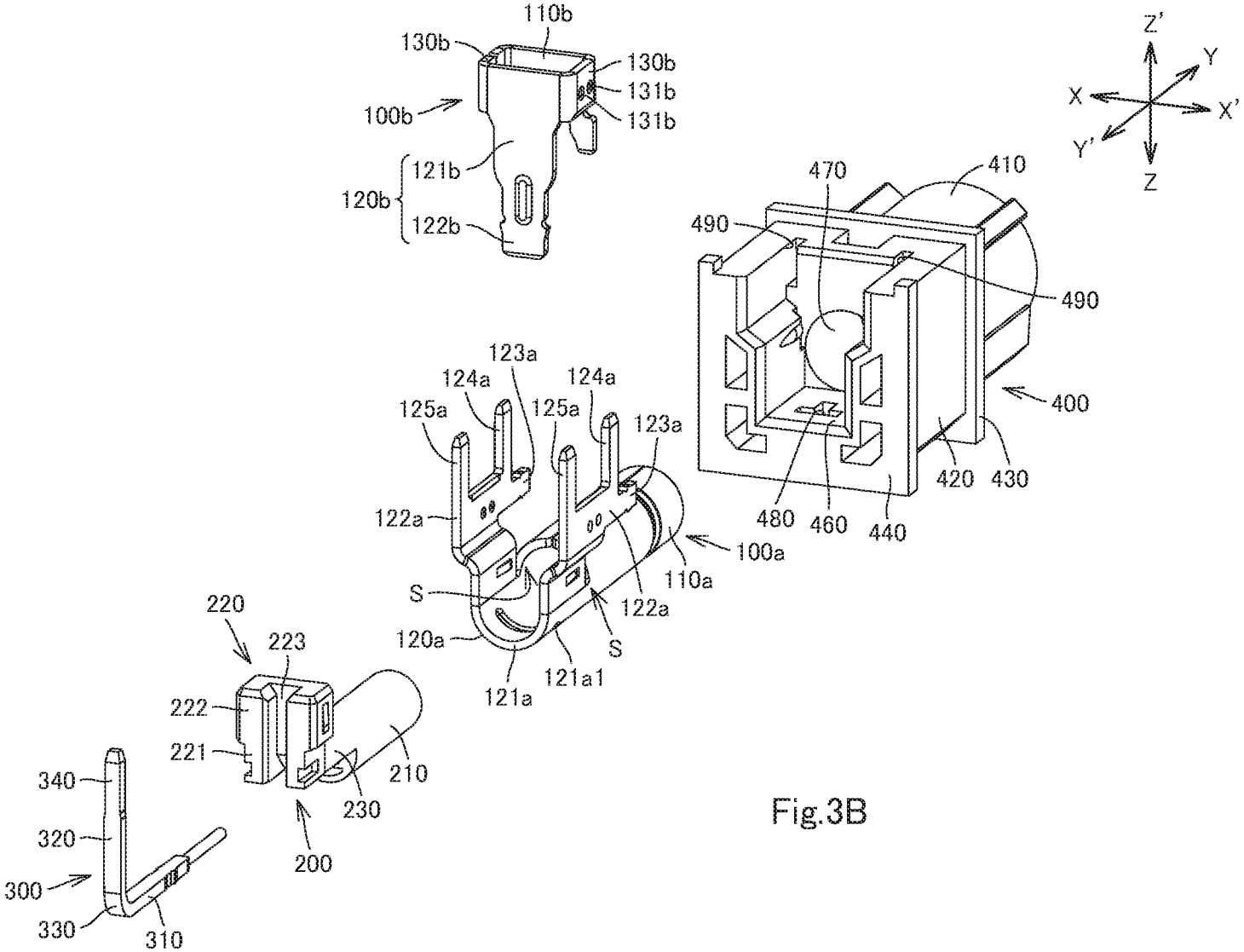
FIG. 3B is a back, bottom, right perspective exploded view of the connector.

The body 200 is made of an insulating resin. As best illustrated in FIG. 3A and FIG. 3B, the body 200 includes a connecting portion 210, a basal portion 220, and a middle portion 230. The connecting portion 210 is a block extending in the Y-Y' direction. The connecting portion 210 includes a front portion on the Y-direction side, a rear portion on the Y'-direction side, a connecting hole 211, and a lock hole 212. The connecting hole 211 extends in the Y-Y' direction in the front portion of the connecting portion 210 and opens to the Y-direction. The lock hole 212 extends in the Y-Y' direction centrally in the rear portion of the connecting portion 210 and opens to the Y-direction (see FIG. 2A). The connecting hole 211 communicates with the lock hole 212. In the first embodiment, the connecting portion 210 is a block of circular cylindrical shape, and the connecting hole 211 is a hole of circular cylindrical shape.

The basal portion 220 is a block extending in the Z-Z' direction. The basal portion 220 includes an upper portion 221, a lower portion 222, and a groove 223. The upper portion 221 is a portion on the Z-direction side of the basal portion 220. The lower portion 222 is a portion on the Z'-direction side of the basal portion 220 and contiguous with the upper portion 221. The upper portion 221 and the lower portion 222 may have the same dimension or different dimensions in the X-X' direction. In the first embodiment, the lower portion 222 has a larger X-X' direction dimension than that of the upper portion 221. The groove 223 extends in the Z-Z' direction, passing through the basal portion 220 and opening to the Y'-direction.

The middle portion 230 joins together the connecting portion 210 and the upper portion 221 of the basal portion 220. In the first embodiment, the middle portion 230 is shaped like a lower half of a circular cylinder. The middle portion 230 is located on the Z'-direction side relative to the lock hole 212 of the connecting portion 210.

As best illustrated in FIG. 3A and FIG. 3B, the terminal 300 is a generally L-shaped metal plate. The terminal 300 includes a first portion 310, a second portion 320, a bent portion 330, and a tail 340. The first portion 310 is a plate extending in the Y-Y' direction. The first portion 310 includes a front portion on the Y-direction side, a rear portion on the Y'-direction side, and a middle portion between the front portion and the rear portion. As best illustrated in FIG. 2A, the front portion of the first portion 310 is disposed inside the connecting hole 211 of the connecting portion 210 of the body 200. In the first embodiment, the front portion of the first portion 310 is disposed in the connecting hole 211 such as to extend along the central axis of the connecting hole 211. The front portion serves as a contact portion to make contact with a terminal of a mating connector. The rear portion of the first portion 310 is disposed on the middle portion 230 of the body 200. The middle portion of the first portion 310 is securely received in the lock hole 212 of the connecting portion 210.

The bent portion 330 is a generally L-shaped plate joining together the first portion 310 and the second portion 320. The bent portion 330 is received in the groove 223. The second portion 320 in the first embodiment is a plate extending from the bent portion 330 in the Z-Z' direction. Alternatively, the second portion 320 may extend in an oblique direction including components of the Y-Y' and Z-Z' directions. For example, the oblique direction may be a direction including the Z-Z' direction with a slant in the Y' direction. The second portion 320 is received in the groove 223 of the basal portion 220 of the body 200. The tail 340 extends from the second portion 320 in the Z' direction and protrudes from the groove 223 in the Z' direction. The tail 340 is connectable to a through-hole electrode of a circuit board (not shown). The tail 340 may be modified such as to extend from the second portion 320 in the Y' direction and be connectable to an electrode on the circuit board.

As illustrated in FIG. 2A to FIG. 4C, the shield case 100 houses the terminal 300 and the body 200. The shield case 100 includes a first shell 100*a* and a second shell 100*b*. The first shell 100*a* is electrically conductive. The first shell 100*a* may be a metal plate formed by stamping as in the first embodiment but may alternatively be formed by casting. The first shell 100*a* includes the connecting portion 110*a* mentioned above and a cover 120*a*.

The connecting portion 110*a* is a tube extending in the Y-Y' direction. The connecting portion 110*a* is the portion adapted to fit in a connecting hole in a shell of a mating connector. The connecting portion 110*a* houses the first portion 310 of the terminal 300, the connecting portion 210 of the body 200, and the middle portion 230 of the body 200 (see FIG. 2A). The connecting portion 210 of the body 200 snugly or loosely fits in the connecting portion 110*a*. In the first embodiment, the connecting portion 210 snugly fits in the connecting portion 110*a* and holds the first portion 310 of the terminal 300. As held by the connecting portion 210, the first portion 310 of the terminal 300 is disposed in the connecting portion 110*a* such as to extend along the central axis of the connecting portion 110*a*.

The connecting portion 110*a* includes a first portion 111*a* on the Z-direction side and a second portion 112*a* on the Z'-direction side. As cut on a plane containing the Z-Z' and X-X' directions, the first portion 111*a* has a cross-section in the shape of an upper half of a circle, an arc shape, an inverted U-like shape, or an inverted V-like shape. The second portion 112*a* may be the portion excluding the first portion 111*a* of the connecting portion 110*a*), or the connecting portion 110*a* may further include another portion between the first and second portions 111*a* and 112*a*. As cut on a plane containing the Z-Z' and X-X' directions, the second portion 112*a* has a cross-section in the shape of an lower half of a circle, an arc shape, a U-like shape, or a V-like shape.

In the first embodiment, as best illustrated in FIG. 3A and FIG. 3B, the connecting portion 110*a* is a circular tube extending in the Y-Y' direction, in which the first portion 111*a* is the half of the circular tube on the Z-direction side and the second portion 112*a* is the other half of the circular tube on the Z'-direction side. In other words, as cut on a plane containing the Z-Z' and X-X' directions, the first portion 111*a* has a cross-section in the shape of an upper half of a circle, and the second portion 112*a* has a cross-section in the shape of the lower half of the circle.

As used herein, the term "upper half of a circle" includes an upper half of an ellipse, and the term "lower half of a circle" includes a lower half of an ellipse. As used herein, the term "inverted U-like shape" includes a shape consisting of an upper base and a pair of legs of a trapezoid/trapezium with the upper base being shorter than the lower base. The term "inverted U-like shape" also includes a shape consisting of an upper side and a pair of lateral sides, which is perpendicular to the upper side, of a square or rectangle (i.e. an inverted angular U-like shape). Similarly, the term "U-like shape" includes a shape consisting of a lower base and a pair of legs of a trapezoid/trapezium with the lower base being shorter than the upper base. The term "U-like shape" also includes a shape consisting of a lower side and a pair of lateral sides, which is perpendicular to the lower side, of a square or rectangle (i.e. an angular U-like shape).

The cover 120*a* extends in the Y-Y' direction contiguously from the first portion 111*a* of the connecting portion 110*a*.

The cover 120*a* includes a coupling portion 121*a* and a pair of walls 122*a* (first and second walls of the cover). The walls 122*a* of the cover 120*a* and the second shell 100*b* constitute a composite tube. The composite tube is circular or polygonal tube extending in the Z-Z' direction or the above-described oblique direction. The composite tube in the first embodiment is a rectangular tube extending in the Z-Z' direction and includes a wall on the X-direction side, a wall on the X'-direction side, a wall on the Y-direction side, and a wall on the Y'-direction side.

The coupling portion 121*a* extends from the first portion 111*a* in the Y' direction such as to be located on the Z-direction side relative to the basal portion 220 of the body 200, and the bent portion 330 of the terminal 300. As cut on a plane containing the Z-Z' and X-X' directions, the coupling portion 121*a* has a cross-sectional shape that is similar shape to that of the first portion 111*a* of the connecting portion 110*a*. In the first embodiment, the coupling portion 121*a* has a cross-section in the shape of an upper half of a circle on a plane containing the Z-Z' and X-X' directions. In other words, the coupling portion 121*a* is shaped like a half of a circular tube. The top of the coupling portion 121*a* is provided with an engaging hole 121*a*1. The engaging hole 121*a*1 passes through the coupling portion 121*a* in the Z-Z' direction. The coupling portion 121*a* further includes an X-direction end portion (first end portion of the coupling portion) and an X'-direction end portion (second end portion of the coupling portion).

The walls 122*a* extend in the Z' direction respectively from the X-direction end and the X'-direction end portion of the coupling portion 121*a*. The walls 122*a* include a first wall 122*a* (first wall of the cover) and a second wall 122*a* (second wall of the cover). The first wall 122*a* is a part or the whole of the wall on the X-direction side of the composite tube. The other wall 122*a* is a part or the whole of the wall on the X'-direction side of the composite tube. The walls 122*a* each include an upper wall 122*a*1, a lower wall 122*a*2, and a bent portion 122*a*3. The upper walls 122*a*1 are rectangular plates on the Z-direction side of the walls 122*a*. The upper walls 122*a*1 may abut on, or may face in spaced relation to, the respective side faces on the X- and X'-direction sides of the upper portion 221 of the basal portion 220 of the body 200. The upper walls 122*a*1 in the first embodiment abut on these side faces.

Figure 4A:
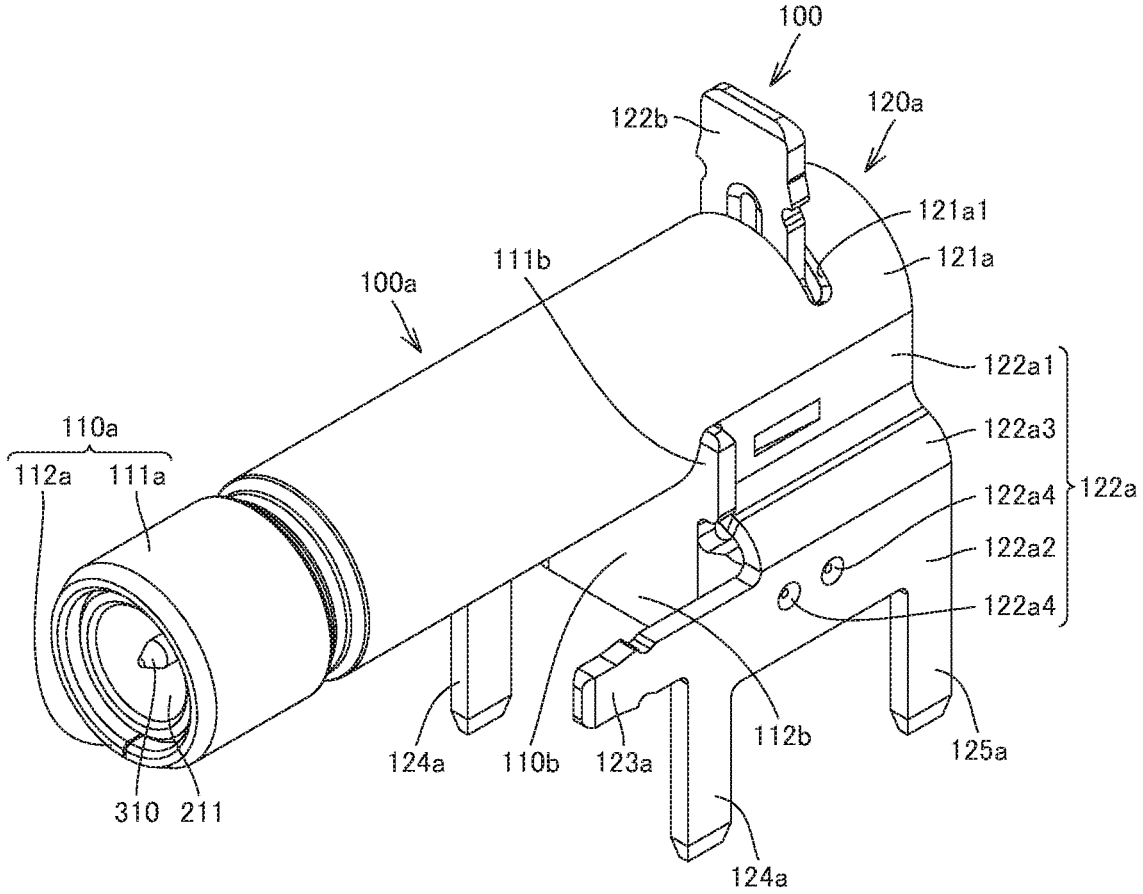
FIG. 4A is a front, top, left perspective view of a shield case and a terminal of the connector.
Figure 4B:
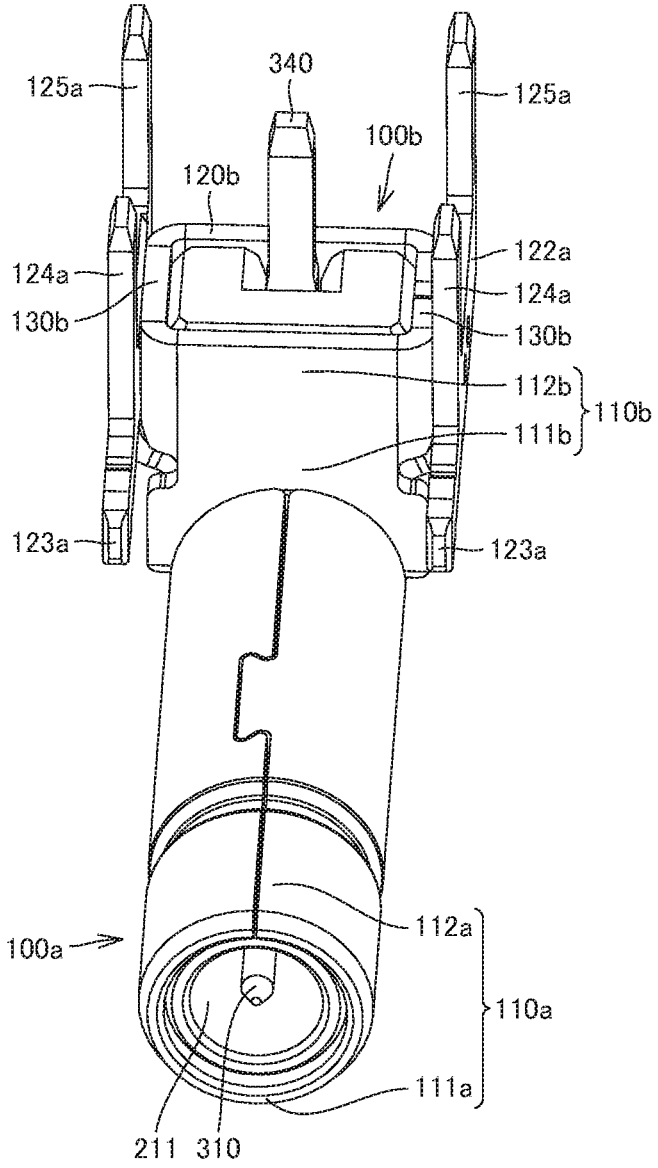
FIG. 4B is a front, bottom, right perspective view of the shield case, a body, and the terminal of the connector.
Figure 4C:
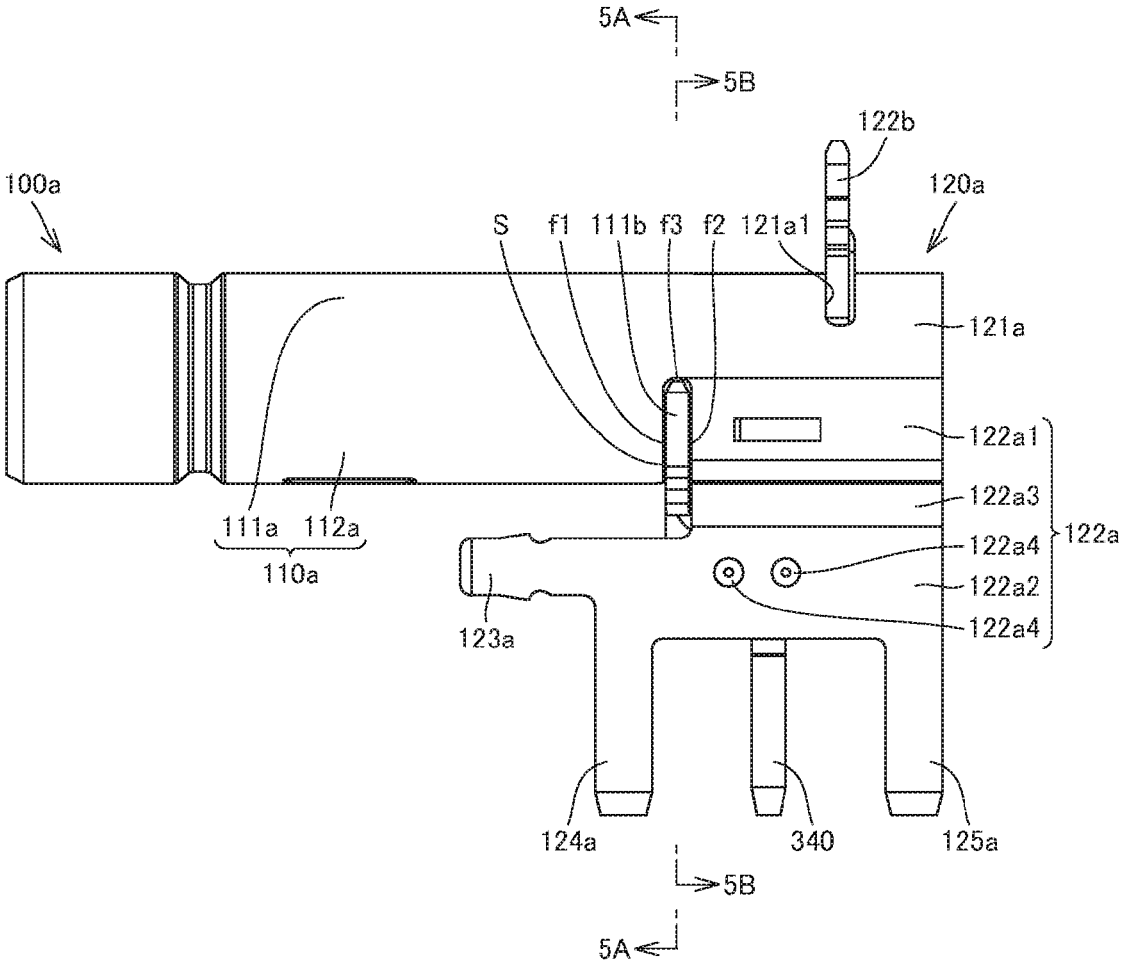
FIG. 4C is a left side view of the shield case and the terminal of the connector.

The upper walls 122*a*1 of the walls 122*a* are opposed to the second portion 112*a* of the connecting portion 110*a*, with interstices S left between the upper walls 122*a*1 and the second portion 112*a* (see FIG. 3A and FIG. 4C). If the first shell 100*a* is formed by stamping, interstices S may appear for the following reasons. It is required to form the connecting portion 110*a* in a tuboid shape and form the upper walls 122*a*1 such as to extend in the Z' direction from the coupling portion 121*a* by a stamping process. Accordingly, the stamping process should involve separation of the upper walls 122*a*1 from the second portion 112*a* of the connecting portion 110*a*. Accordingly, when separating the upper walls 122*a*1 from the second portion 112*a*, interstices S appears between the second portion 112*a* and the upper walls 122*a*1. This is particularly true for cases where the second portion 112*a* of the connecting portion 110*a* has a cross-section on a plane containing the Z-Z' and X-X' directions, in the shape of an lower half of a circle, an arc shape, a U-like shape (excluding an angular U-like shape), or a V-like shape. For convenience of explanation, the interstices S are defined by an end face f1, a pair of end faces f2, and a pair of end faces f3. The end face f1 is an end face in the Y'-direction (opposing face) of the second portion 112*a*. The end faces f2 are respective end faces in the Y-direction (opposing faces) of the pair of upper walls 122*a*1. The end face f1 is opposed to the pair of end faces f2 in the Y-Y' direction. The end faces f3 are end faces of the X- and X'-direction end portions, respectively, of the coupling portion 121*a* of the cover 120*a*, and they are located on the Z-direction side of the interstices S and face in the Z'-direction. The body 200 may further include a protruding portion 240. The protruding portion 240 of the body 200 may be disposed between the interstices S.

The lower walls 122*a*2 of the walls 122*a* are rectangular plates on the Z'-direction side of the walls 122*a*. The lower walls 122*a*2 can be mounted on the circuit board. The lower walls 122*a*2 have a Y-Y' direction dimension that may be the same as or different from the Y-Y' direction dimension of the upper walls 122*a*1. In the first embodiment, the lower walls 122*a*2 has a larger Y-Y' direction dimension than that of the upper walls 122*a*1. The lower walls 122*a*2 are located on the outer side relative to the upper walls 122*a*1. In other words, the distance in the X-X' direction is larger between the lower walls 122*a*2 than between the upper walls 122*a*1. Each bent portion 122*a*3 joins together each upper wall 122*a*1 and each lower wall 122*a*2. The bent portions 122*a*3 are bent such that the lower walls 122*a*2 are located on the outer side relative to the upper walls 122*a*1. The bent portions 122*a*3 can be omitted, in which case each upper wall 122*a*1 and each lower wall 122*a*2 may continuously extend a straight line in the Z-Z' direction.

The first shell 100*a* may further include a pair of arms 123*a*. The arms 123*a* extend in the Y direction from the respective lower walls 122*a*2 of the walls 122*a*. The first shell 100*a* may further include a pair of first legs 124*a* and/or a pair of second legs 125*a*. The first legs 124*a* extend in the Z' direction from the respective Y-direction end portions of the lower walls 122*a*2 of the walls 122*a*. The second legs 125*a* extend in the Z' direction from the respective Y'-direction end portions of the lower walls 122*a*2 of the walls 122*a*. The first legs 124*a* and/or second legs 125*a* may be connectable to grounding through-hole electrodes in the circuit board mentioned above. Alternatively, the first legs 124*a* and/or second legs 125*a* may extend in the X-X' direction such as to be connectable to surface electrodes on the circuit board.

The second shell 100*b* is electrically conductive. The second shell 100*b* is a separate component from the first shell 100*a*. The second shell 100*b* may be a metal plate formed by stamping as in the first embodiment but may alternatively be formed by casting.

Figure 2B:
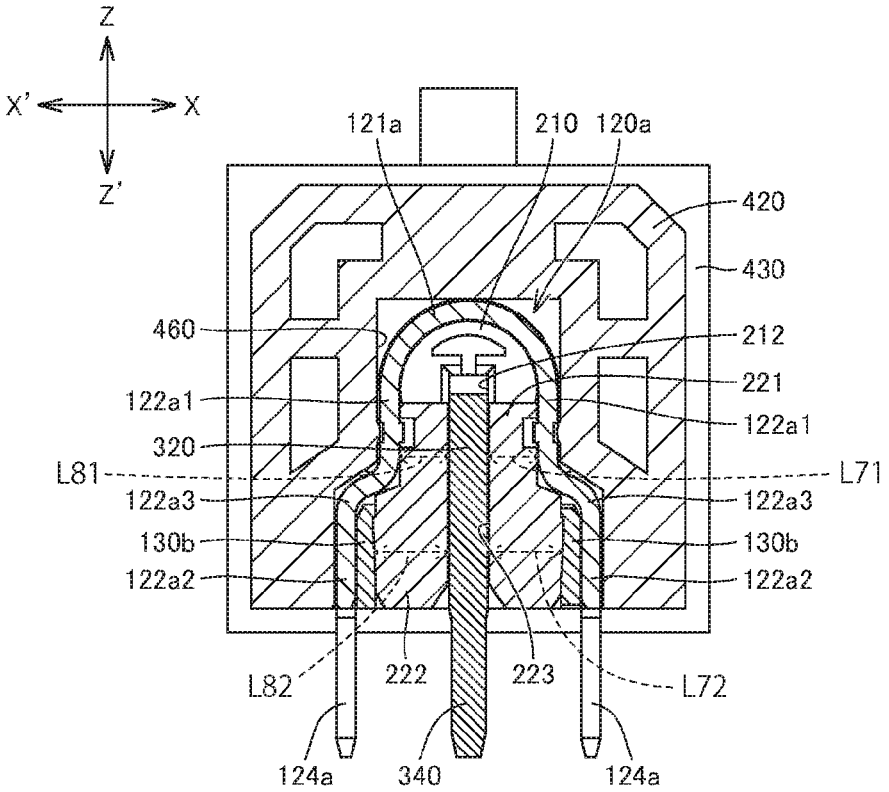
FIG. 2B is a sectional view of the connector, taken along 2B-2B in FIG. 2A.
Figure 2C:
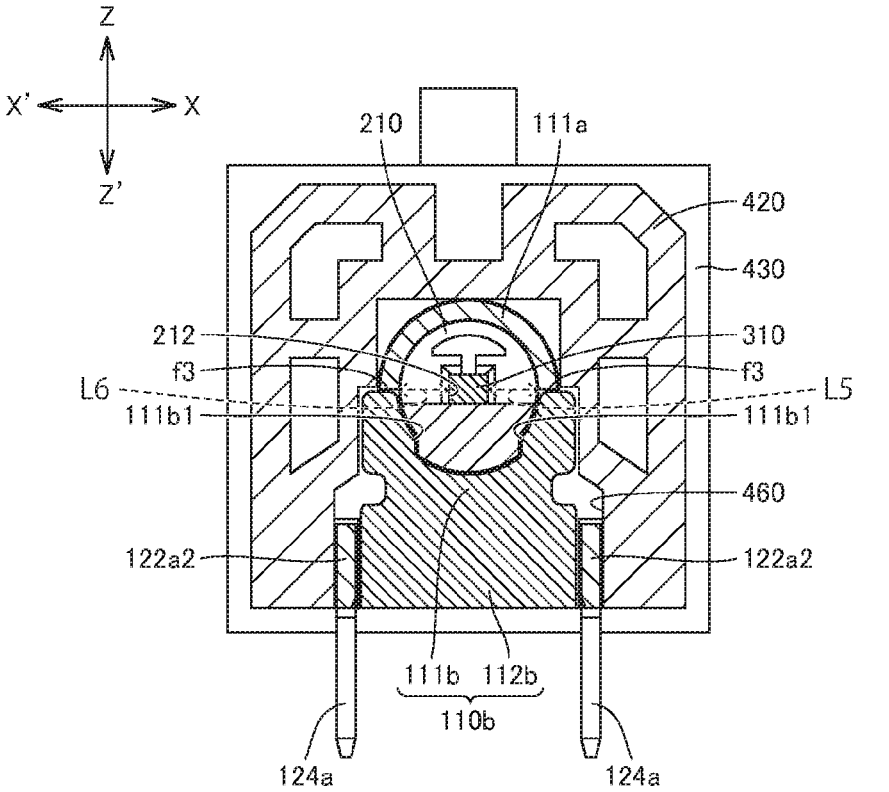
FIG. 2C is a sectional view of the connector, taken along 2C-2C in FIG. 2A.
Figure 5A:
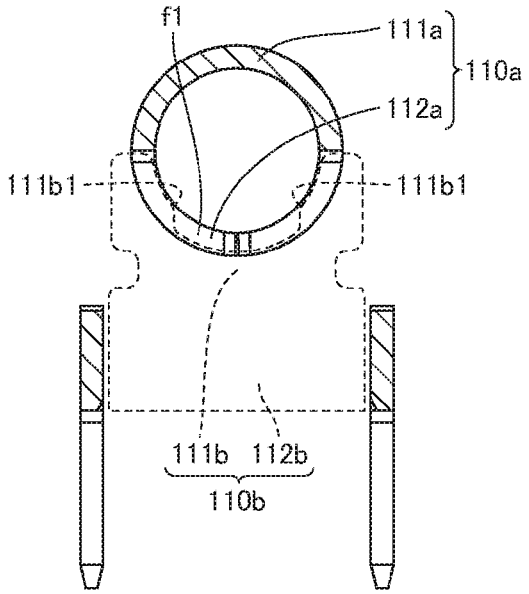
FIG. 5A is a sectional view taken along 5A-5A in FIG. 4C, illustrating the position of a connecting portion of a first shell of the shield case relative to a first blocking portion of a second shell.
Figure 5B:
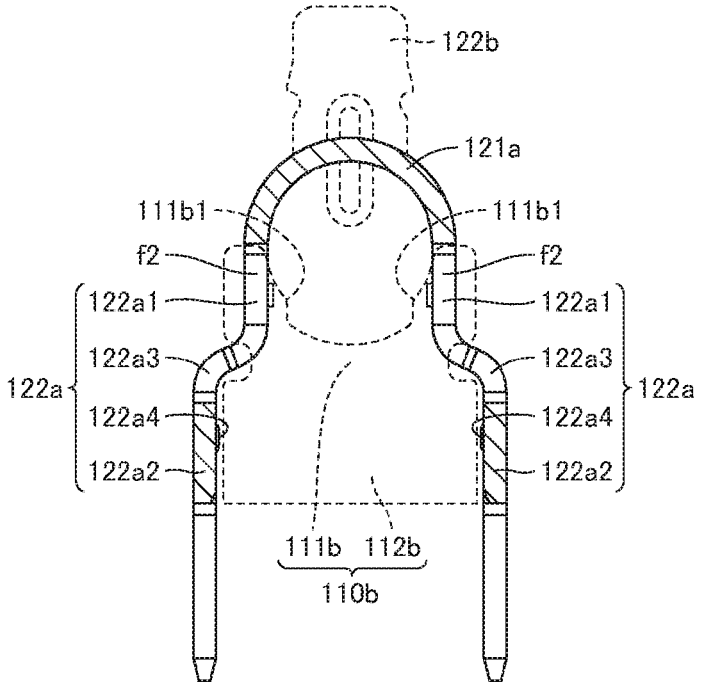
FIG. 5B is a sectional view taken along 5B-5B in FIG. 4C, illustrating the position of a cover of the first shell of the shield case relative to the first blocking portion of the second shell.

The second shell 100*b* includes a first blocking portion 110*b* and a second blocking portion 120*b*. As best illustrated in FIG. 2C, FIG. 5A, and FIG. 5B, the first blocking portion 110*b* is a metal plate extending in the Z-Z' and X-X' directions. The first blocking portion 110*b* is disposed on the Y-direction side of the space between the walls 122*a* such as to block the space. The first blocking portion 110*b* is the wall on the Y-direction side of the composite tube. The first blocking portion 110*b* includes a distal portion 111*b* and a basal portion 112*b*. The distal portion 111*b* is a generally U-shaped plate. The distal portion 111*b* has a Y-Y' direction dimension that is substantially the same as or slightly larger than the Y-Y' direction dimension of the interstices S (see FIG. 4C). The distal portion 111*b* has an X-X' direction dimension that is larger than the X-X' direction dimension of the connecting portion 110*a* and than the X-X' direction distance between the outer faces of the upper walls 122*a*1 of the pair of walls 122*a* (see FIG. 4B). The distal portion 111*b* has a recessed face. The recessed face has a cross-sectional shape, on a plane containing the Z-Z' and X-X' directions, that corresponds to the cross-sectional shape of the second portion 112*a* of the connecting portion 110*a*. The distal portion 111*b* fits between the second portion 112*a* and the upper walls 122*a*1, abutting the end face f1 of the second portion 112*a*, the end faces f2 of the upper walls 122*a*1 of the walls 122*a*, and the end faces f3 (abutting faces) of the coupling portion 121*a*. The distal portion 111*b* thus blocks the interstices S substantially completely.

A pair of lugs 111*b*1 is provided on the recessed face of the distal portion 111*b*. The X-X' direction distance between the lugs 111*b*1 is slightly smaller than the X-X' direction dimension of the protruding portion 240 of the body 200. With the lugs 111*b*1 engaged with the protruding portion 240, the distal portion 111*b* holds the protruding portion 240, so that the first blocking portion 110*b* is fixed to the body 200.

The basal portion 112*b* has an X-X' direction dimension that is substantially the same as the X-X' direction dimension between the inner faces of the lower walls 122*a*2 of the walls 122*a*. The basal portion 112*b* abuts on the inner faces of the lower walls 122*a*2.

Figure 2D:
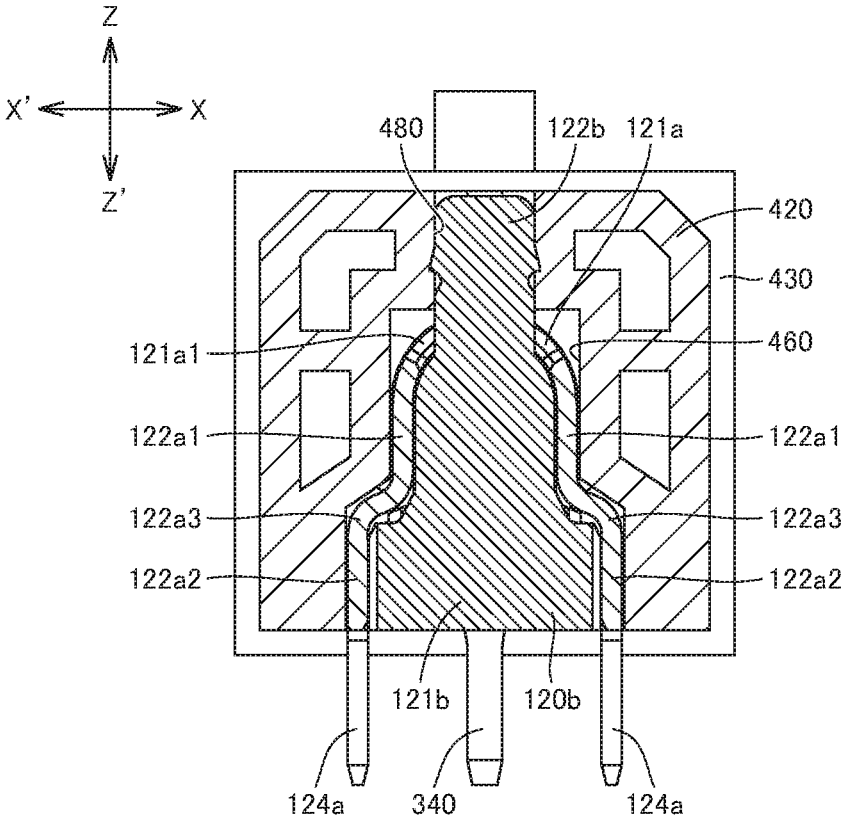
FIG. 2D is a sectional view of the connector, taken along 2D-2D in FIG. 2A.

As best illustrated in FIG. 2D, the second blocking portion 120*b* is a metal plate extending in the Z-Z' and X-X' directions. The second blocking portion 120*b* includes a main body 121*b* and an engaging piece 122*b*. The main body 121*b* has a cross-sectional shape, on a plane containing the Z-Z' and X-X' directions, that corresponds to that of the cover 120*a*. The main body 121*b* is disposed on the Y'-direction side of the space between the walls 122*a* such as to block the space. The main body 121*b* constitutes the wall on the Y'-direction side of the composite tube. The main body 121*b* abuts the inner faces of the upper walls 122*a*1 and the inner faces of the lower walls 122*a*2 of the walls 122*a*. The engaging piece 122*b* is a plate extending from the main body 121*b* in the Z direction. The engaging piece 122*b* has a protrusion protruding in the Y' direction. The engaging piece 122*b* has an X-X' direction dimension that is smaller than that of the engaging hole 121*a*1 of the cover 120*a*. The engaging piece 122*b* has a Y-Y' direction dimension (including the Y-Y' direction dimension of the protrusion) is slightly larger than the Y-Y' direction dimension of the engaging hole 121*a*1. The engaging piece 122*b* extends through and is engaged with the engaging hole 121*a*1 from the Z'-direction side, so that the main body 121*b* blocks the engaging hole 121*a*1 from the Z'-direction side.

Figure 2E:
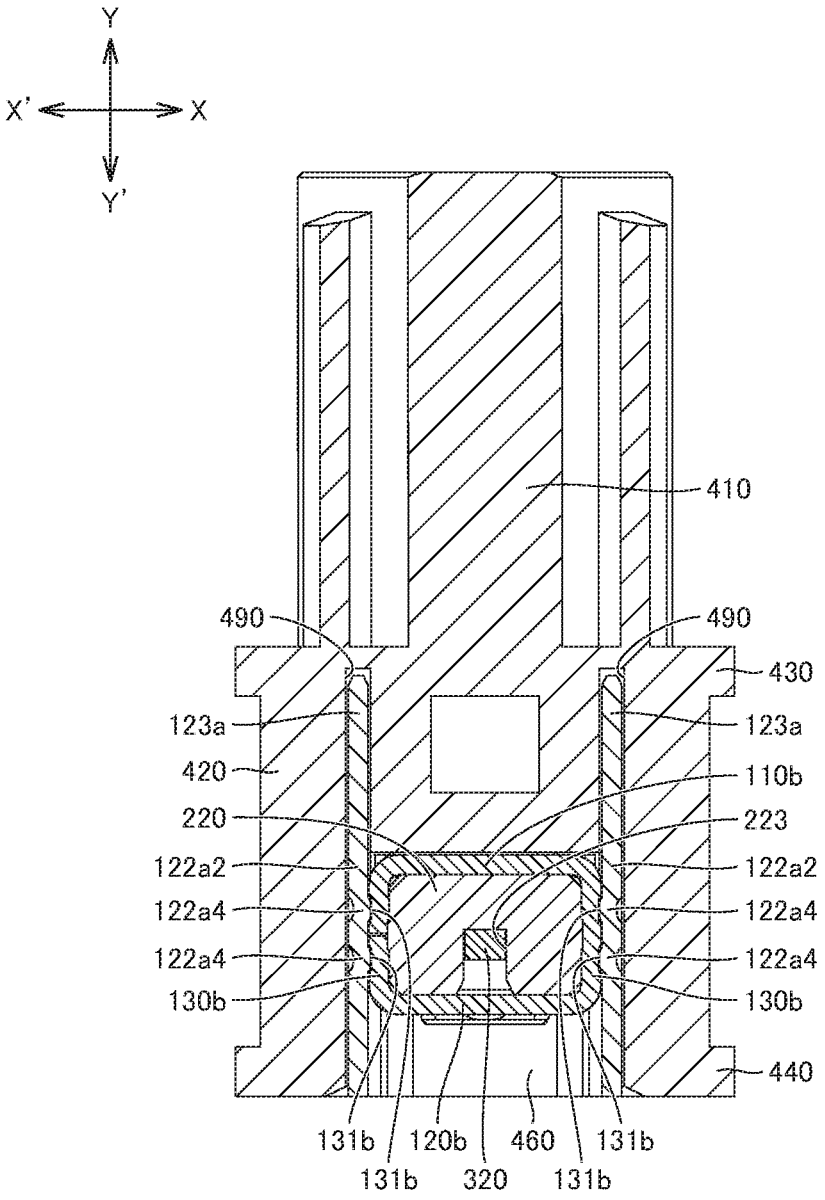
FIG. 2E is a sectional view of the connector, taken along 2E-2E in FIG. 2A.

The second shell 100*b* may further include a pair of walls 130*b* (first and second walls of the second shell). As best illustrated in FIG. 2B and FIG. 2E, the walls 130*b* join together the first blocking portion 110*b* and the second blocking portion 120*b* such as to be located on the inner side relative to the lower walls 122*a*2 of the walls 122*a* of the first shell 100*a*, i.e. each located between each lower walls 122*a*2 and the lower portion 222 of the basal portion 220 of the body 200. The walls 130*b* may or may not be in surface contact with the lower walls 122*a*2 of the walls 122*a*. In the first embodiment, the walls 130*b* are in surface contact with the lower walls 122*a*2 of the walls 122*a*. In this case, the walls 130*b* each has a Z-Z' direction dimension that is substantially the same as or slightly smaller than that of the lower wall 122*a*2 of each wall 122*a*. The walls 130*b* includes a first wall 130*b* (first wall of the second shell) and a second wall 130*b* (second wall of the second shell). The first wall 130*b* and the first wall 122*a* constitute the wall on the X-direction side of the composite tube. The second wall 130*b* and the second wall 122*a* constitute the wall on the X'-direction side of the composite tube. In an embodiment where the walls 130*b* are omitted, the first wall 122*a* alone constitutes the wall on the X-direction side of the composite tube, and the second wall 122*a* alone constitutes the wall on the X'-direction side of the composite tube.

The composite tube houses the basal portion 220 of the body 200, the bent portion 330 of the terminal 300, and the second portion 320 of the terminal 300. The Y-Y' direction distance between the first blocking portion 110*b* and the second blocking portion 120*b* may be substantially equal to the Y-Y' direction dimension of the lower portion 222 of the basal portion 220 of the body 200. The X-X' direction distance between the walls 130*b* may be substantially equal to the X-X' direction dimension of the lower portion 222 of the basal portion 220. In other words, the first blocking portion 110*b*, the second blocking portion 120*b*, and the walls 130*b* defines a space adapted to fittingly house the lower portion 222 of the basal portion 220.

Impedance matching between the first portion 310 and the second portion 320 of the terminal 300 is achieved by setting at least distances L1 to L4 or distances L5 to L8 as defined below, for example by setting the distances L1 to L8. In the first embodiment, distances L1 to L6, L71, L72, L81, and L82 as defined below are set such as to provide matched impedances between the first portion 310 and the second portion 320 of the terminal 300. Here, L1 (see FIG. 2A) is the distance in the Z direction from the first portion 310 of the terminal 300 to the connecting portion 110*a*. L2 (see FIG. 2A) is the distance in the Z' direction from the first portion 310 of the terminal 300 to the connecting portion 110*a*. L3 (see FIG. 2A) is the distance in the Y direction from the second portion 320 of the terminal 300 to the composite tube (to the first blocking portion 110*b* in the first embodiment). L4 (see FIG. 2A) is the distance in the Y' direction from the second portion 320 of the terminal 300 to the composite tube (to the second blocking portion 120*b* in the first embodiment,). L5 (see FIG. 2C) is the distance in the X direction from the first portion 310 of the terminal 300 to the connecting portion 110*a*. L6 (see FIG. 2C) is the distance in the X' direction from the first portion 310 of the terminal 300 to the connecting portion 110*a*. L7 (not shown) is the distance in the X direction from the second portion 320 of the terminal 300 to the composite tube (for example, L71 or L72). L8 (not shown) is the distance in the X' direction from the second portion 320 of the terminal 300 to the composite tube (for example, L81 or L82). L71 (see FIG. 2B) is the distance in the X direction from the second portion 320 of the terminal 300 to the upper walls 122*a*1 of the first wall 122*a* of the composite tube. L72 (see FIG. 2B) is the distance in the X direction from the second portion 320 of the terminal 300 to the first wall 130*b* of the composite tube. L81 (see FIG. 2B) is the distance in the X' direction from the second portion 320 of the terminal 300 to the upper wall 122*a*1 of the second wall 122*a* of the composite tube. L82 (see FIG. 2B) is the distance in the X' direction from the second portion 320 of the terminal 300 to the second wall 130*b* of the composite tube.

The walls 130*b* may include at least one engaging portion 131*b* (second engaging portion of the second shell). The walls 122*a* may include at least one engaging portion 122*a*4 (first engaging portion of the cover). One of the engaging portion 131*b* and the engaging portion 122*a*4 is an engaging protrusion, and the other is an engaging recess or an engaging hole. The engaging protrusion is engaged with the engaging recess or hole. In the first embodiment, as best illustrated in FIG. 2E, each engaging portions 122*a*4 is an engaging protrusion protruding inward (i.e. to the side of the adjacent wall 130*b*), and each engaging portion 131*b* is an engaging recess dented inward. In the first embodiment, a plurality of engaging portions 122*a*4 are provided on the lower wall 122*a*2 of each wall 122*a*, and a plurality of engaging portions 131*b* are provided on each wall 130*b*.

The case 400 is made of an insulating resin. The case 400 houses the terminal 300, the body 200, and the shield case 100. As illustrated in FIG. 1A to FIG. 3B, the case 400 includes a tube 410, a block 420, a plate 430, and another plate 440. The tube 410 extends from the plate 430 in the Y direction. A connecting hole 450 extends inside the tube 410. The connecting hole 450 is configured to receive a connecting portion of a mating connector. The block 420 is a rectangular parallelepiped body provided between the plate 430 and the plate 440.

A housing recess 460 is provided in the plate 440 and the block 420. The housing recess 460 has a shape conforming to the outer shape of the cover 120*a* of the shield case 100 to allow the cover 120*a* to fit in the housing recess 460. The housing recess 460 opens to the Y'-direction and the Z'-direction. The block 420 has an engaging hole 480 on the Z-direction side of the housing recess 460. The engaging hole 480 communicates with the housing recess 460, and also with the engaging hole 121*a*1 of the cover 120*a* as disposed in the housing recess 460. The engaging hole 480 is engaged with the engaging piece 122*b* of the second shell 100*b*. A communicating hole 470 is provided between and in communication with the connecting hole 450 and the housing recess 460 of the case 400. The communicating hole 470 has a shape conforming to the outer shape of the connecting portion 110*a* of the first shell 100*a*. The communicating hole 470 fits around a part of the connecting portion 110*a*. The connecting hole 450 houses the distal portion of the connecting portion 110*a*, the distal portion of the connecting portion 210 of the body 200, and the distal portion of the first portion 310 of the terminal 300. A pair of engaging holes 490 is provided on the Z'-direction side relative to the communicating hole 470 of the case 400. As best illustrated in FIG. 2E, the engaging holes 490 are engaged with the respective arms 123*a* of the first shell 100*a*.

The connector C1 in the first embodiment as described above may be assembled in the following steps. First, the terminal 300 and the body 200 are prepared. The first portion 310 of the terminal 300 is press-fitted into the lock hole 212 of the body 200 from the Y'-direction side, and the bent portion 330 and the second portion 320 of the terminal 300 are inserted into the groove 223 of the body 200 from the Y'-direction side. Then, the middle portion of the first portion 310 of the terminal 300 is partially held in the lock hole 212, the distal portion of the first portion 310 is disposed in the connecting hole 211 of the body 200, and the rear portion of the first portion 310 is disposed on the middle portion 230 of the body 200. Also, the bent portion 330 and the second portion 320 of the terminal 300 are housed in the groove 223 of the body 200. The terminal 300 is thus held by the body 200.

The first shell 100*a* is also prepared. The body 200 is mounted into the first shell 100*a* in the following arrangements 1) to 4): 1) the connecting portion 210 of the body 200 fits into the connecting portion 110*a* of the first shell 100*a* from the Y'-direction side; 2) the first portion 310 of the terminal 300 is coaxially disposed inside the connecting portion 110*a* of the first shell 100*a;* 3) the basal portion 220 of the body 200, and the bent portion 330 and the second portion 320 of the terminal 300 are disposed inside the cover 120*a* of the first shell 100*a*; and 4) the upper portion 221 of the basal portion 220 of the body 200 is brought into surface contact with and engagement with the inner faces of the upper walls 122*a*1 of the cover 120*a*.

The case 400 is also prepared. The connecting portion 110*a* of the first shell 100*a* is inserted into the housing recess 460, the communicating hole 470, and the connecting hole 450 of the case 400 from the Y'-direction side in the following arrangements 1) to 3): 1) the connecting portion 110*a* is partially held in the communicating hole 470, and the distal portion of the connecting portion 110*a* is disposed inside the connecting hole 450; 2) the arms 123*a* of the first shell 100*a* are brought into engagement with the respective engaging holes 490 of the case 400; and 3) the cover 120*a* of the first shell 100*a* is housed in the housing recess 460 of the case 400, so that the engaging hole 121*a*1 of the cover 120*a* communicates with the engaging hole 480 of the case 400. The case 400 thus houses the first shell 100*a*, the terminal 300, and the body 200.

The second shell 100*b* is prepared. The second shell 100*b* is attached to the first shell 100*a* from the Z'-direction side in the following arrangements 1) to 9): 1) the distal portion 111*b* of the first blocking portion 110*b* of the second shell 100*b* fits between the second portion 112*a* of the connecting portion 110*a* of the first shell 100*a* and the walls 122*a*, and the first blocking portion 110*b* is also brought into abutment with the end face f1 of the second portion 112*a*, the end faces f2 of the walls 122*a*, and the end faces f3 of the coupling portion 121*a* such as to block the interstices S between the end face f1 and the end faces f2; 2) the protruding portion 240 of the body 200 is fittingly held between the prongs of the U-shaped distal portion 111*b* of the first blocking portion 110*b* of the second shell 100*b;* 3) the first blocking portion 110*b* of the second shell 100*b* blocks the space between the walls 122*a* of the first shell 100*a*, on the Y-direction side relative to the basal portion 220 of the body 200; 4) the engaging piece 122*b* of the second blocking portion 120*b* is brought into engagement, from the Z'-direction side, with the engaging hole 121*a*1 of the first shell 100*a* and the engaging hole 480 of the case 400, and the second blocking portion 120*b* blocks the engaging hole 121*a*1 from the Z'-direction side; 5) the second blocking portion 120*b* blocks the space between the walls 122*a* of the first shell 100*a*, on the Y'-direction side relative to the basal portion 220 of the body 200; 6) the walls 130*b* are placed on the inner side of the walls 122*a* such as to be in surface contact with the walls 122*a;* 7) the engaging portions 131*b* of the walls 130*b* are brought into engagement with the engaging portions 122*a*4 of the walls 122*a;* 8) the basal portion 220 of the body 200 fits into the second shell 100*b*, and the second portion 320 of the terminal 300 is partially placed into the second shell 100*b*; and 9) the pair of walls 122*a* of the cover 120*a*, the first blocking portion 110*b* of the second shell 100*b*, the second blocking portion 120*b* of the second shell 100*b*, and the pair of walls 130*b* of the second shell 100*b* constitute the composite tube.

The above-described connector C1 has at least the following technical features. First, the connector C1 has a high degree of design flexibility for the reason below. The second shell 100*b* is a separate member from the first shell 100*a*. Accordingly, the second shell 100*b* is not restricted to such a shape as to be contiguous with the shape of the connecting portion 110*a* of the first shell 100*a*.

Secondly, the terminal 300 of the connector C1 has matched impedance between the first portion 310 and the second portion 320 for the reason below. As discussed above, the second shell 100*b* can be formed separately from the connecting portion 110*a* of the first shell 100*a*, facilitating the design of the second shell 100*b* such as to match impedances between the first portion 310 and the second portion 320 of the terminal 300. This means facilitation of the design of the composite tube, which is constituted by the second shell 100*b* and the pair of walls 122*a* of the first shell 100*a*, such as to match impedances between the first portion 310 and the second portion 320. Specifically, it is allowed to form the composite tube, free from the above restriction in design, setting the distances L1 to L4 and/or distances L5 to L8 such as to match impedances between the first portion 310 and the second portion 320.

Third, the connector C1 is configured to be suitable for matching impedance between the first portion 310 and the second portion 320 of the terminal 300. More particularly, 1) the coupling portion 121*a* has the engaging hole 121*a*1 in order to attach the second shell 100*b* to the coupling portion 121*a* of the first shell 100*a*, but the existence of the engaging hole 121*a*1 produces little or no adverse effect on impedance matching between the first portion 310 and the second portion 320. This is because the engaging hole 121*a*1 of the first shell 100*a* is engaged with the engaging piece 122*b* of the second shell 100*b* so as to be blocked with the main body 121*b* of the second shell 100*b*. 2) The interstices S are left between the second portion 112*a* of the connecting portion 110*a* of the first shell 100*a* and the pair of walls 122*a*, but the existence of the interstices S produces little or no adverse effect on impedance matching between the first portion 310 and the second portion 320. This is because the interstices S are blocked with the first blocking portion 110*b* of the second shell 100*b*. 3) Attaching the shield case 100 to the case 400 produces little or no adverse effect on impedance matching between the first portion 310 and the second portion 320. A shield case is fixed to the case typically with an engaging piece, which is formed by cutting and raising a part of the shield case. The cut-and-raised portion of the shield case leaves an opening in the shield case, and such an opening produces an adverse effect on impedance matching between first and second portions of a terminal. However, the connector C1 is configured such that the engaging piece 122*b* of the second shell 100*b* is engaged with the engaging hole 121*a*1 of the first shell 100*a* and the engaging hole 480 of the case 400, and the engaging hole 121*a*1 is blocked with the main body 121*b* of the second shell 100*b* as described above. The shield case 100 can be fixed to the case 400 without leaving any unblocked openings in the first shell 100*a* or the second shell 100*b*.

Fourth, the connector C1 has favorable voltage standing wave ratio (VSWR) for the following reason. Electrical connection between the first shell 100*a* and the second shell 100*b* is established by engaging the engaging piece 122*b* of the second shell 100*b* with the engaging hole 121*a*1 of the first shell 100*a*, and by bringing the walls 130*b* of the second shell 100*b* into surface contact with the walls 122*a* of the first shell 100*a*. As a result, the first shell 100*a* and the second shell 100*b* are at the same potential, so that the second shell 100*b* will not electrically float. Moreover, the surface contact between the walls 122*a* of the first shell 100*a* and the walls 130*b* of the second shell 100*b* means that the first shell 100*a* is electrically connected to the second shell 100*b* in the vicinity of the first legs 124*a* and/or the second legs 125*a*. As the first legs 124*a* and/or second legs 125*a* are connected to the ground, the first shell 100*a* is electrically connected to the second shell 100*b* in the vicinity of the ground. This arrangement improves VSWR of the connector C1.

Fifth, the connector C1 is configured such as to prevent the second shell 100*b* from falling off the first shell 100*a*. More particularly, the engaging piece 122*b* of the second shell 100*b* is engaged with the engaging hole 121*a*1 of the first shell 100*a*. The distal portion 111*b* of the first blocking portion 110*b* fits in between the second portion 112*a* of the connecting portion 110*a* and the walls 122*a* of the first shell 100*a*. The protruding portion 240 of the body 200 is held by the distal portion 111*b* of the first blocking portion 110*b*. The engaging portions 131*b* of the second shell 100*b* are engaged with the engaging portions 122*a*4 of the first shell 100*a*.

Sixth, the connector C1 has an improved pry resistance in the X-X' direction for the following reason. The walls 130*b* of the second shell 100*b* are in surface contact with the walls 122*a* of the first shell 100*a* from the inside of the walls 122*a*. In other words, the walls 122*a* with the first arm 124*a* and/or the second arm 125*a* are reinforced from the inside with the walls 130*b*. Therefore, when the connector C1 is connected to a mating connector and pried in the X-X' direction, the applied load will not be concentrated onto the walls 122*a*.

Second Embodiment

Figure 6A:
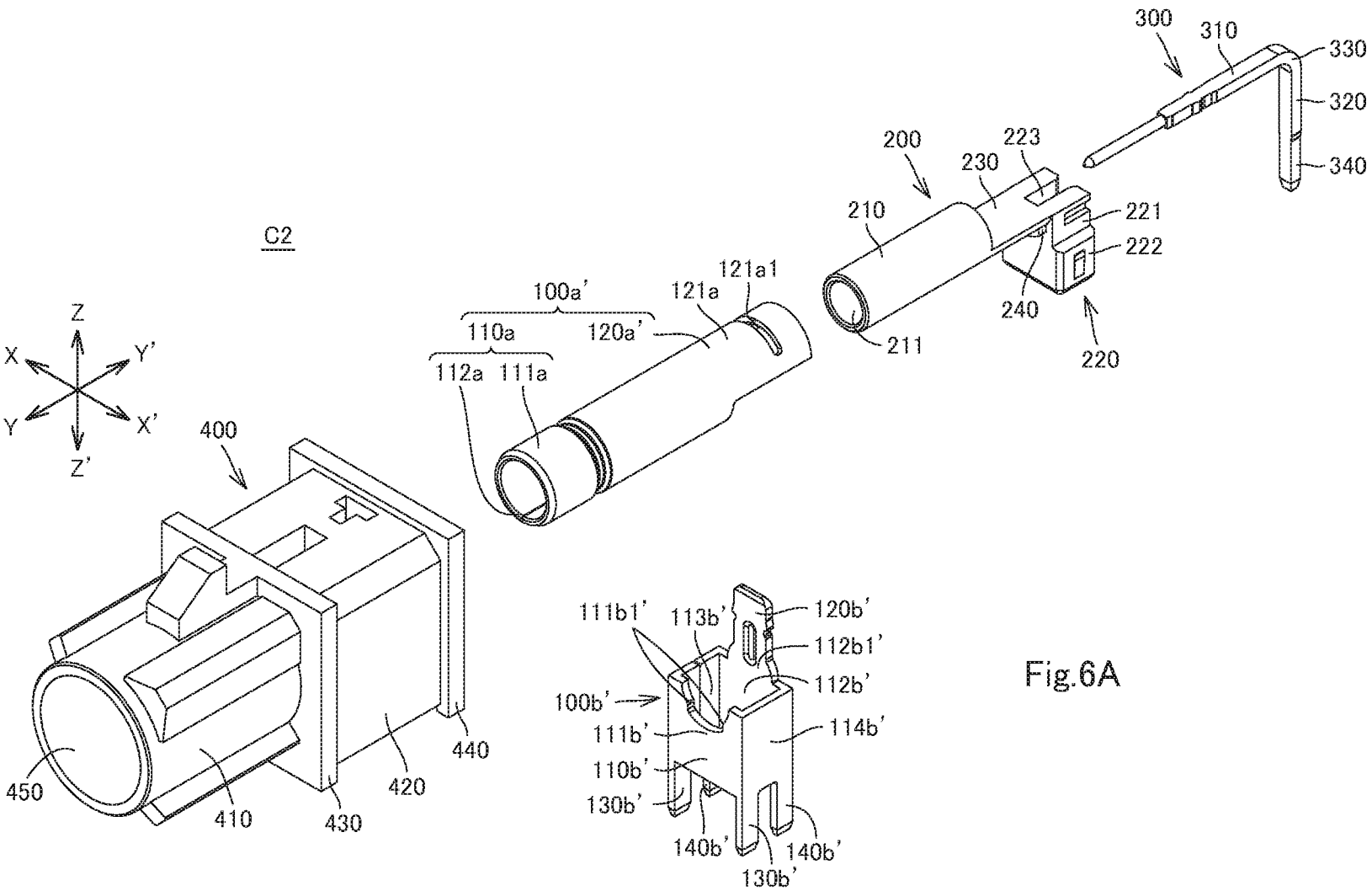
FIG. 6A is a front, top, left perspective exploded view of a connector in accordance with the second embodiment of the invention.
Figure 6B:
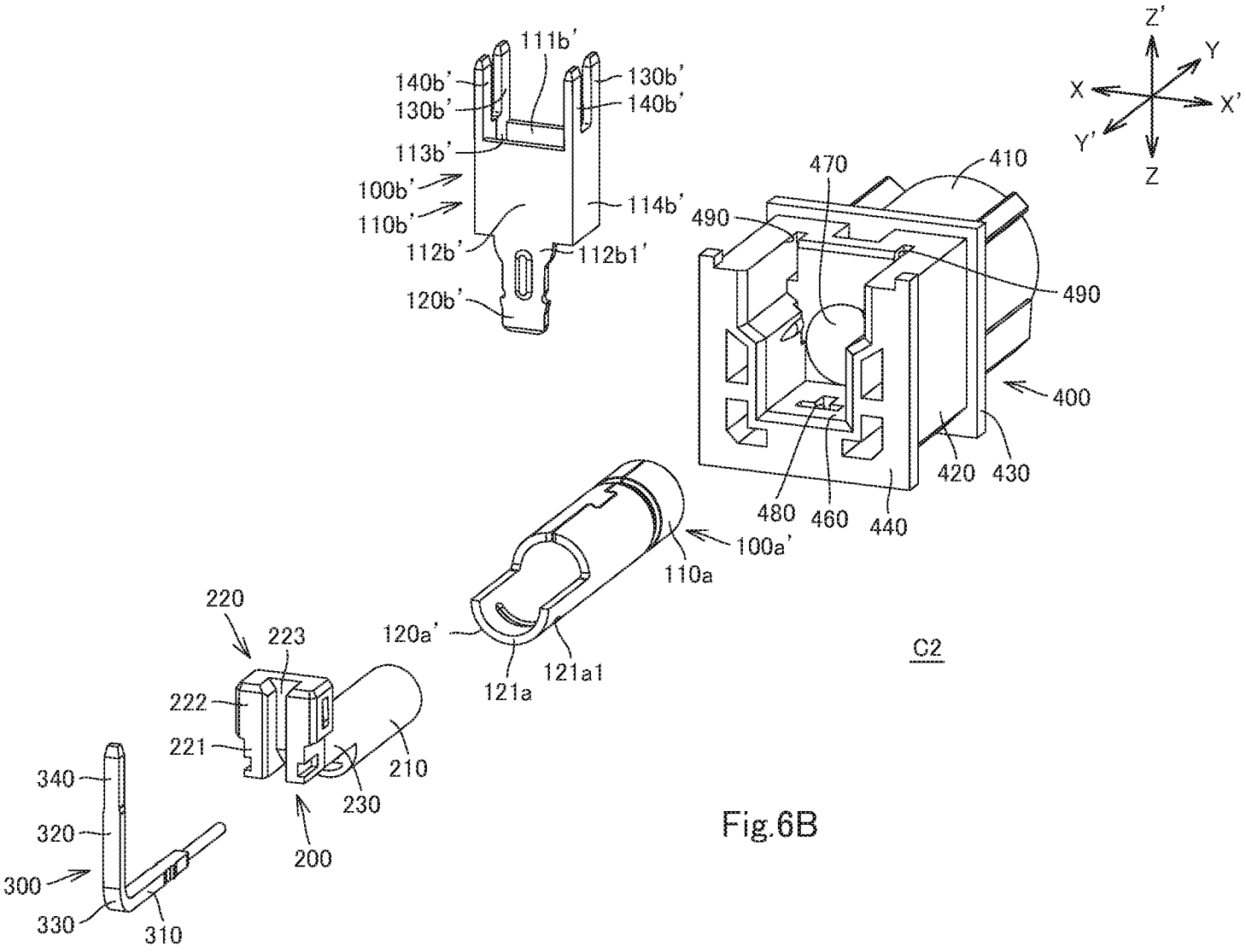
FIG. 6B is a back, bottom, right perspective exploded view of the connector.

A connector C2 in accordance with the second embodiment of the invention will be described below with reference to FIG. 6A and FIG. 6B. The connector C2 has a similar configuration to that of the connector C1 but includes a shield case 100' of different configuration from that of the shield case 100 in the first embodiment. The difference will be described below in detail, and overlapping descriptions will be omitted.

The shield case 100' includes a first shell 100*a*' and a second shell 100*b*'. The first shell 100*a*' is different from the first shell 100*a* in the first embodiment in that a cover 120*a*' consists only of the coupling portion 121*a*.

The second shell 100*b*' is a tube extending in the Z-Z' direction or the above-described oblique direction. In the second embodiment, the second shell 100*b*' is a rectangular tube extending in the Z-Z' direction. The second shell 100*b*' has a tuboid main body 110*b*' and an engaging piece 120*b*'.

The main body 110*b*' houses the basal portion 220 of the body 200, and the bent portion 330 and the second portion 320 of the terminal 300. The main body 110*b*' includes a wall 111*b*' on the Y-direction side, a wall 112*b*' on the Y'-direction side, a wall 113*b*' on the X-direction side, and a wall 114*b*' on the X'-direction side. Impedance matching between the first portion 310 and the second portion 320 of the terminal 300 is achieved by setting at least distances L1, L2, L3', and L4' or distances L5, L6, L7', and L8' as defined below. For example, as in the present second embodiment, the distances L1 to L8 may be set such as to provide matched impedances between the first portion 310 and the second portion 320 of the terminal 300. Here, the distances L1, L2, L5, and L6 in the second embodiment are defined in the same manner as the distances L1, L2, L5, and L6 in the first embodiment. L3' (not shown) is the distance in the Y direction from the second portion 320 of the terminal 300 to the second shell 100*b*' (particularly the wall 111*b*' in the second embodiment). L4' (not shown) is the distance in the Y' direction from the second portion 320 of the terminal 300 to the second shell 100*b*' (particularly the wall 112*b*' in the second embodiment). L7' (not shown) is the distance in the X direction from the second portion 320 of the terminal 300 to the second shell 100*b*' (particularly the wall 113*b*' in the second embodiment). L8' (not shown) is the distance in the X' direction from the second portion 320 of the terminal 300 to the second shell 100*b*' (particularly the wall 114*b*' in the second embodiment).

The Z-direction end portion of the wall 111*b*' is formed with a recessed face. The recessed face of the wall 111*b*' may have the same configuration as the recessed face of the first blocking portion 110*b* in the first embodiment. A pair of lugs 111*b*1' is provided on the recessed face of the wall 111*b*'. The X-X' direction distance between the lugs 111b1' is slightly smaller than the X-X' direction dimension of the protruding portion 240 of the body 200. With the lugs 111b1' engaged with the protruding portion 240, the wall 111b' holds the protruding portion 240, so that the main body 110b' is fixed to the body 200.

The Z-direction end of the wall 112b' is provided with a protruding portion 112b1' protruding in the Z direction. The engaging piece 120b' extends in the Z direction from the protruding portion 112b1' of the wall 112b'. Except for this, the engaging piece 120b' has the same configuration as the engaging piece 122b in the first embodiment. The engaging piece 120b' extends through and is engaged with the engaging hole 121a1 of the first shell 100a' from the Z'-direction side, so that the protruding portion 112b1' blocks the engaging hole 121a1 from the Z'-direction side.

The second shell 100b' may further include first legs 130b' and/or second legs 140b'. The first legs 130b' and/or the second legs 140b' extend from the main body 110b' in the Z' direction or the X-X' direction. The first legs 130b' and/or the second legs 140b' extending in the Z' direction are connectable with grounding through-hole electrodes in the circuit board. The first legs 130b' and/or the second legs 140b' extending in the X-X' direction are connectable with surface electrodes on the circuit board.

The connector C2 in the second embodiment as described above may be assembled in the following steps. First, the terminal 300 is placed such as to be held by the body 200 as in the first embodiment. The first shell 100a' is also prepared. The body 200 is mounted into the first shell 100a' in the following arrangements 1) to 3): 1) the connecting portion 210 of the body 200 fits into the connecting portion 110a of the first shell 100a' from the Y'-direction side; 2) the first portion 310 of the terminal 300 is coaxially disposed inside the connecting portion 110a of the first shell 100a'; and 3) the basal portion 220 of the body 200, and the bent portion 330 and the second portion 320 of the terminal 300 are disposed on the Z'-direction side relative to the cover 120a' of the first shell 100a'.

The case 400 is also prepared. The connecting portion 110a of the first shell 100a' is inserted into the housing recess 460, the communicating hole 470, and the connecting hole 450 of the case 400 from the Y'-direction side in the following arrangements 1) and 2): 1) the connecting portion 110a is partially held in the communicating hole 470, and the distal portion of the connecting portion 110a is disposed inside the connecting hole 450; and 2) the cover 120a' is housed in the housing recess 460 of the case 400, so that the engaging hole 121a1 of the cover 120a' communicates with the engaging hole 480 of the case 400. The case 400 thus houses the first shell 100a', the terminal 300, and the body 200.

The second shell 100b' is prepared. The second shell 100b' is attached to the first shell 100a' from the Z'-direction side in the following arrangements 1) to 4): 1) the basal portion 220 of the body 200 fits in the main body 110b' of the second shell 100b', and the bent portion 330 and the second portion 320 of the terminal 300 are housed in the main body 110b'; 2) the protruding portion 240 of the body 200 fits in the recessed face of the wall 111b' of the second shell 100b', and the protruding portion 240 is held between the prongs of the U-shaped portion of the wall 111b'; 3) the engaging piece 120b' is engaged with the engaging hole 121a1 of the first shell 100a' and the engaging hole 480 of the case 400 from the Z'-direction side; and 4) the protruding portion 112b1' of the wall 112b' blocks the engaging hole 121a1 of the first shell 100a' from the Z'-direction side.

The above-described connector C2 has at least the following technical features. First, the connector C2 has a high degree of design flexibility for the reason below. The second shell 100b' is a separate member from the first shell 100a'. Accordingly, the second shell 100b' is not restricted to such a shape as to be contiguous with the shape of the connecting portion 110a of the first shell 100a'.

Secondly, the terminal 300 of the connector C2 has matched impedance between the first portion 310 and the second portion 320 for the reason below. As discussed above, the second shell 100b' can be formed separately from the connecting portion 110a of the first shell 100a', facilitating the design of the second shell 100b' such as to match impedances between the first portion 310 and the second portion 320 of the terminal 300. Specifically, it is allowed to shape the main body 110b' of the second shell 100b' setting the distances L1, L2, L3', and L4', and/or distances L5, L6, L7', and L8' such as to match impedances between the first portion 310 and the second portion 320.

Third, the connector C2 is configured to be suitable for matching impedance between the first portion 310 and the second portion 320 of the terminal 300. More particularly, 1) the coupling portion 121a has the engaging hole 121a1 in order to attach the second shell 100b' to the coupling portion 121a of the first shell 100a', but the existence of the engaging hole 121a1 produces little or no adverse effect on impedance matching between the first portion 310 and the second portion 320. This is because the engaging hole 121a1 of the first shell 100a' is engaged with the engaging piece 120b' of the second shell 100b' so as to be blocked with the main body 110b' of the second shell 100b'. 2) Attaching the shield case 100' to the case 400 produces little or no adverse effect on impedance matching between the first portion 310 and the second portion 320. A shield case is fixed to the case typically by engaging an engaging piece, which is formed by cutting and raising a part of the shield case, with an engaging hole or recess in the case. The cut-and-raised portion of the shield case leaves an opening in the shield case, and such an opening produces an adverse effect on impedance matching between first and second portions of a terminal. However, the connector C2 is configured such that the engaging hole 121a1 of the first shell 100a' and the engaging hole 480 of the case 400 are engaged with the engaging piece 120b' of the second shell 100b, and the engaging hole 121a1 is blocked with the main body 110b' of the second shell 100b' as described above. The shield case 100' can be fixed to the case 400 without leaving any unblocked openings in the first shell 100a' or the second shell 100b'.

Fourth, the connector C2 has favorable VSWR for the following reason. Electrical connection between the first shell 100a' and the second shell 100b' is established by engaging the engaging piece 120b' of the second shell 100b' with the engaging hole 121a1 of the first shell 100a'. As a result, the first shell 100a' and the second shell 100b' are at the same potential, so that the second shell 100b' will not electrically float.

Fifth, the connector C2 is configured such as to prevent the second shell 100b' from falling off the first shell 100a'. This is because the engaging piece 120b' of the second shell 100b' is engaged with the engaging hole 121a1 of the first shell 100a'.

The connectors described above are not limited to the configurations of the above embodiments but may be modified in any manner within the scope of the claims as discussed below.

The terminal of the invention may be any terminal including a first portion extending in a first direction, and a second portion extending in a second direction or an oblique direction. The second direction is orthogonal to the first direction. The oblique direction is a direction including components of the first and second directions. The invention may provide a plurality of the terminals.

The body of the invention may be any insulating member configured to hold the terminal or terminals in any one of the above aspects.

The shield case of the invention may any shield case meeting the following requirements: 1) the shield case is configured to house the at least one terminal and the body in any one of the above aspects; and 2) the shield case includes the first and second shells in any one of the above aspects or first and second shells to be described below.

The first shell of the invention may be any shell meeting the following requirements: 1) the first shell is electrically conductive; 2) the first shell includes a connecting portion, which is of tuboid shape and extends in the first direction, and a cover or a coupling portion; 3) the first portion of the at least one terminal is disposed inside the connecting portion; and 4) the cover or coupling portion of the first shell extends in the first direction contiguously from the connecting portion.

The connecting portion of the first shell of the invention may include a first portion on one side in the second direction of the connecting portion and a second portion on the other side in the second direction of the connecting portion. The first portion and the second portion of the connecting portion of the first shell may be modified in shape as described above for the first embodiment.

The second shell of the invention may be any shell meeting the following requirements: 1) the second shell is a separate member from the first shell in any one of the above aspects; 2a) the second shell is attached to the cover of the first shell in any one of the above aspects, wherein the second shell and the cover constitute a composite tube, which extends in the second direction or the oblique direction; or alternatively, 2b) the second shell is a separate member from the first shell in any one of the above aspects, is attached to the coupling portion, and is of tuboid shape extending in the second direction or the oblique direction; and 3) the second portion of the at least one terminal is disposed inside the composite tube or inside the second shell of tuboid shape.

The composite tube of the invention is not limited to the configuration described for the first embodiment but covers various aspects such as ones as described below. A composite tube in an aspect includes first and second walls of the cover of the first shell, and first and second blocking portions of the second shell. The first wall, the second wall, the first blocking portion, and the second blocking portion respectively correspond to the wall on the X-direction side, the wall on the X'-direction side, the wall on the Y-direction side, and the wall on Y'-direction side of the composite tube. It is preferable in this aspect that the first wall and the second wall be contiguous with or attached to opposite ends in the X-X' direction of the coupling portion of the cover.

A composite tube in an aspect includes first and second walls of the cover of the first shell, and first and second blocking portions of the second shell. The first wall, the second wall, the first blocking portion, and the second blocking portion respectively correspond to the wall on the Y-direction side, the wall on the Y'-direction side, the wall on the X-direction side, and the wall on X'-direction side of the composite tube. It is preferable in this aspect that the first wall of the cover be contiguous with or attached to the second portion of the connecting portion of the first shell, and that the second wall of the cover be contiguous with or attached to the coupling portion of the cover.

A composite tube according to still another aspect includes first, second, and third walls of the cover of the first shell, and a first blocking portion of the second shell. The first wall, the second wall, the third wall, and the first blocking portion respectively correspond to the wall on the X-direction side, the wall on the X'-direction side, the wall on the Y-direction side, and the wall on Y'-direction side of the composite tube. It is preferable in this aspect that the first wall and the second wall of the cover be contiguous with or attached to opposite ends in the X-X' direction of the coupling portion of the cover, and that the third wall of the cover may be contiguous with or attached to either the second portion of the connecting portion or the coupling portion of the cover of the first shell.

A composite tube according to still another aspect includes first, second, and third blocking portions of the second shell, and a first wall of the cover of the first shell. The first blocking portion, the second blocking portion, the third blocking portion, and the first wall respectively correspond to the wall on the X-direction side, the wall on the X'-direction side, the wall on the Y-direction side, and the wall on Y'-direction side of the composite tube. It is preferable in this aspect that the first wall of the cover be contiguous with or attached to either the second portion of the connecting portion or the coupling portion of the cover of the first shell.

A composite tube according to still another aspect includes first, second, and third walls of the cover of the first shell, and a first blocking portion of the second shell. The first wall and the second wall respectively correspond to the wall on the Y-direction side and the wall on the Y'-direction side of the composite tube. The third wall and the first blocking portion respectively correspond to the wall on the X-direction side and the wall on the X'-direction side of the composite tube, or alternatively correspond respectively to the wall on the X'-direction side and the wall on the X-direction side of the composite tube. It is preferable in this aspect that the first wall of the cover be contiguous with or attached to the second portion of the connecting portion of the first shell, that the second wall of the cover be contiguous with or attached to the coupling portion of the cover, and that the third wall of the cover be contiguous with or attached to the X- or X'-direction end of the coupling portion of the cover of the first shell.

A composite tube according to still another aspect includes first, second, and third blocking portions of the second shell, and a first blocking portion of the cover of the first shell. The first blocking portion and the second blocking portion respectively correspond to the wall on the Y-direction side and the wall on the Y'-direction side of the composite tube. The third blocking portion and the first wall respectively correspond to the wall on the X-direction side and the wall on the X'-direction side of the composite tube, or alternatively correspond respectively to the wall on the X'-direction side and the wall on the X-direction side of the composite tube. It is preferable in this aspect that the first wall of the cover be contiguous with or attached to the X'- or X-direction end of the coupling portion of the cover of the first shell.

The walls of the composite tube of any aspects described above may preferably extend in the second direction or the oblique direction. In the composite tube of any aspects, distances L1 to L4 and/or distances L5 to L8 can be set such as to provide matched impedances between the first portion and the second portion of the terminal. The distances L1 to L8 are defined as described above for the first embodiment.

The walls on the X and X'-direction sides of the composite tube in any one of the above aspects may be in contact with the second portion of the connecting portion of the first shell in any one of the above aspects. In other words, the walls on the X and X'-direction sides of the composite tube may be disposed with no interstices from the second portion of the connecting portion of the first shell.

The second shell of the invention may not include the first wall or the second wall of the second shell. The second shell of the invention may include at least one of the first wall and the second wall of the second shell. The first wall of the second shell of the invention may be any wall joining together the first blocking portion and the second blocking portion in any one of the above aspects, and being disposed inside or outside of the first wall of the cover in any one of the above aspects. The second wall of the second shell of the invention may be any wall joining together the first blocking portion and the second blocking portion in any one of the above aspects, and being disposed inside or outside of the second wall of the cover in any one of the above aspects. The first wall of the cover and the first wall of the second shell in any one of the above aspects may be in contact or in engagement with each other. The second wall of the cover and the second wall of the second shell in any one of the above aspects may be in contact or in engagement with each other. The first wall of the cover and the first wall of the second shell in any one of the above aspects may not be in contact with each other. The second wall of the cover and the second wall of the second shell in any one of the above aspects may not be in contact with each other. The first wall of the cover and/or the first wall of the second shell in any one of the above aspects may constitute any wall of the composite tube in any one of the above aspects. The second wall of the cover and/or the second wall of the second shell in any one of the above aspects may constitute any wall of the composite tube in any one of the above aspects.

The first blocking portion of the second shell of the invention may or may not block interstices between the second portion of the connecting portion in any one of the above aspects and the first and second walls of the cover in any one of the above aspects. The first blocking portion may block the interstices in any manner. For example, the first blocking portion may fit in between the second portion of the connecting portion in any one of the above aspects and the first and second walls of the cover so as to be in contact with the opposing face of the second portion and the opposing faces of the first and second walls of the cover. That is, the first blocking portion may not abut on the coupling portion. Alternatively, the first blocking portion may, instead of fitting between the second portion of the connecting portion and the first and second walls of the cover, abut on an outer face of the second portion and the opposing faces of the first and second walls of the cover so as to block the interstices. In this case, the distal portion of the first blocking portion may have a recessed face of shape conforming to the outer face of the second portion. That is, the recessed face of the distal portion of the first blocking portion is in surface contact with the outer face of the second portion, and the end face of the distal portion of the first blocking portion on the side of the walls of the cover is in surface contact with the first and second walls of the cover so as to completely block the interstices. The first blocking portion of the second shell of the invention may fit in the interstices and fixed to the first shell, or may not fit in the interstices. The first blocking portion of the second shell of the invention may or may not be fixed to the body. The body of the invention may have at least one slit in place of the protruding portion. Such a slit or slits may communicate with at least one interstice in any one of the above aspects. The first blocking portion in any one of the above aspects may be engaged with the slit or slits.

The engaging piece of the second shell and the engaging hole of the first shell of the invention may be omitted. The engaging piece of the second shell and the engaging hole of the first shell of the invention may be modified in any manner as long as the engaging piece can engage with the engaging hole. For example, the engaging piece of the second shell may extend in the Z direction from any one of the first blocking portion, the second blocking portion, and the third blocking portion in any one of the above aspects. The engaging piece of the second shell may extend in the Z direction from any one of the walls of the tuboid main body of the second shell. The engaging piece of the second shell may not be engaged with the engaging hole of the case. It is preferable that the engaging hole of the first shell of the invention be located at a position corresponding to the engaging piece of the coupling portion. The second shell of the invention may or may not block the engaging hole of the first shell in any one of the above aspects. For example, any one of the first blocking portion, the second blocking portion, and the third blocking portion in any one of the above aspects may block the engaging hole of the first shell. The tuboid main body of the second shell may block the engaging hole of the first shell.

The case of the invention may be omitted. The case of the invention may be any case configured to house the terminal, the body and the shield case in any one of the above aspects.

It should be appreciated that the connectors of the above embodiments and variants thereof are described above by way of examples only. The materials, shapes, dimensions, numbers, arrangements, and other configurations of the constituents of the shield case and the connector may be modified in any manner if they can perform similar functions. The configurations of the embodiment and the variants described above may be combined in any possible manner. The first direction of the invention may be any direction corresponding to the longitudinal direction of the connecting portion of the first shell of the invention. The second direction of the invention may be any direction crossing the first direction. The third direction of the invention may be any direction that crosses the first direction and the second direction and is non-coplanar with the plane including the first direction and the second direction.

Reference Signs List

- C1: Connector
- 100: Shield case
  - 100a: First shell
    - 110a: Connecting portion
    - 111a: First portion
    - 112a: Second portion
      - f1: End face (opposing face)
    - 120a: Cover
      - 121a: Coupling portion
        - 121a1: Engaging hole
          - f3: End face (contact face)
      - 122a: Wall (first wall and second wall of cover)
        - 122a1: Upper wall
          - f2: End face (opposing face)

-continued

Reference Signs List

122a2: Lower wall
122a3: Bent portion
122a4: Engaging portion (first engaging portion of cover)
123a: Arm
124a: First leg
125a: Second leg
S: Interstice
100b: Second shell
110b: First blocking portion
111b: Distal portion
111b1: Lug
112b: Basal portion
120b: Second blocking portion
121b: Main body
122b: Engaging piece
130b: Wall (first wall and second wall of second shell)
131b: Engaging portion (second engaging portion of second shell)
200: Body
210: Connecting portion
211: Connecting hole
212: Lock hole
220: Basal portion
221: Upper portion
222: Lower portion
223: Groove
230: Middle portion
240: Protruding portion
300: Terminal
310: First portion
320: Second portion
330: bent portion
340: Tail
400: Case
410: Tube
420: Block
430: Plate
440: Plate
450: Connecting hole
460: Housing recess
470: Communicating hole
480: Engaging hole
490: Engaging hole
C2: Connector
100': Shield case
100a': First shell
110a: Connecting portion
111a: First portion
112a: Second portion
120a': Cover
121a: Coupling portion
121a1: Engaging hole
100b': Second shell
110b': Main body
111b': Wall
111b1': Lug
112b': Wall
112b1': Protruding portion
113b': Wall
114b': Wall
120b': Engaging piece
130b': First leg
140b': Second leg
200: Body
210: Connecting portion
211: Connecting hole
212: Lock hole
220: Basal portion
221: Upper portion
222: Lower portion
223: Groove
230: middle portion
240: Protruding portion
300: Terminal
310: First portion
320: Second portion -continued Reference Signs List 330: Bent portion
340: Tail
400: Case
410: Tube
420: Block
430: Plate
440: Plate
450: Connecting hole
460: Housing recess
470: Communicating hole
480: Engaging hole

The invention claimed is:

1. A connector comprising:

a shield case including a first shell and a second shell, the first shell including:

a connecting portion of tuboid shape extending in a first direction, and a cover extending in the first direction contiguously from the connecting portion, wherein the second shell is a separate member from the first shell and attached to the cover, the second shell and the cover constitute a composite tube extending in a second direction or an oblique direction, the second direction is orthogonal to the first direction, and the oblique direction includes components of the first and second directions;

a body having an insulating property and being housed in the shield case; and a terminal held by the body and housed in the shield case, the terminal including:

a first portion extending in the first direction and being disposed inside the connecting portion, and a second portion extending in the second direction or the oblique direction and being disposed inside the composite tube.

2. The connector according to claim 1, wherein the first portion of the terminal is disposed inside the connecting portion such as to extend along a central axis of the connecting portion, distances L1, L2, L3, and L4 are set such as to provide matched impedances between the first portion and the second portion of the terminal, the distance L1 is a distance to one side in the second direction, from the first portion of the terminal to the connecting portion, the distance L2 is a distance to the other side in the second direction, from the first portion of the terminal to the connecting portion, the distance L3 is a distance to one side in the first direction, from the second portion of the terminal to the composite tube, and the distance L4 is a distance to the other side in the first direction, from the second portion of the terminal to the composite tube.

3. The connector according to claim 1, wherein the first portion of the terminal is disposed in the connecting portion such as to extend along a central axis of the connecting portion, distances L5, L6, L7, and L8 are set such as to provide matched impedances between the first portion and the second portion of the terminal, the distance L5 is a distance to one side in a third direction, from the first portion of the terminal to the connecting portion, the distance L6 is a distance to the other side in the third direction, from the first portion of the terminal to the connecting portion, the distance L7 is a distance to the one side in the third direction, from the second portion of the terminal to the composite tube, the distance L8 is a distance to the other side in the third direction, from the second portion of the terminal to the composite tube, and the third direction is orthogonal to the first direction and the second direction.

4. The connector according to claim 1, wherein the cover of the first shell has an engaging hole, the second shell includes:

an engaging piece configured to be engaged with the engaging hole; and a main body configured to block the engaging hole.

5. The connector according to claim 1, wherein the composite tube includes a wall on one side in the first direction, a wall on the other side in the first direction, a wall on one side in a third direction, and a wall on the other side in the third direction, the third direction being orthogonal to the first direction and the second direction, the cover includes:

a first wall constituting at least a part of the wall on the one side in the third direction of the composite tube and extending in the second direction or the oblique direction, and a second wall constituting at least a part of the wall on the other side in the third direction of the composite tube and extending in the second direction or the oblique direction, the second shell includes:

a first blocking portion constituting the wall on the one side in the first direction of the composite tube and extending in the second direction or the oblique direction, and a second blocking portion constituting the wall on the other side in the first direction of the composite tube and extending in the second direction or the oblique direction.

6. The connector according to claim 1, wherein the composite tube includes a wall on one side in the first direction, a wall on the other side in the first direction, a wall on one side in a third direction, and a wall on the other side in the third direction, the third direction being orthogonal to the first direction and the second direction, the cover includes:

a first wall constituting at least a part of the wall on the one side in the first direction of the composite tube and extending in the second direction or the oblique direction, and a second wall constituting at least a part of the wall on the other side in the first direction of the composite tube and extending in the second direction or the oblique direction, the second shell includes:

a first blocking portion constituting the wall on the one side in the third direction of the composite tube and extending in the second direction or the oblique direction, and a second blocking portion constituting the wall on the other side in the third direction of the composite tube and extending in the second direction or the oblique direction.

7. The connector according to claim 1, wherein the composite tube includes a wall on one side in the first direction, a wall on the other side in the first direction, a wall on one side in a third direction, and a wall on the other side in the third direction, the third direction being orthogonal to the first direction and the second direction, the cover includes:

a first wall constituting the wall on the one side in the third direction of the composite tube and extending in the second direction or the oblique direction, a second wall constituting the wall on the other side in the third direction of the composite tube and extending in the second direction or the oblique direction, and a third wall constituting one of the walls on the one and other sides in the first direction of the composite tube and extending in the second direction or the oblique direction, the second shell includes a first blocking portion, the first blocking portion constituting the other one of the walls on the one and other sides in the first direction of the composite tube and extending in the second direction or the oblique direction.

8. The connector according to claim 1, wherein the composite tube includes a wall on one side in the first direction, a wall on the other side in the first direction, a wall on one side in a third direction, and a wall on the other side in the third direction, the third direction being orthogonal to the first direction and the second direction, the second shell includes:

a first blocking portion constituting the wall on the one side in the third direction of the composite tube and extending in the second direction or the oblique direction, a second blocking portion constituting the wall on the other side in the third direction of the composite tube and extending in the second direction or the oblique direction, and a third blocking portion constituting one of the walls on the one and other sides in the first direction of the composite tube and extending in the second direction or the oblique direction, the cover includes a first wall, the first wall constituting the other one of the walls on the one and other sides in the first direction of the composite tube and extending in the second direction or the oblique direction.

9. The connector according to claim 5, wherein the second shell includes:

a first wall joining together the first blocking portion and the second blocking portion, the first wall of the second shell being disposed inside or outside of the first wall of the cover; and a second wall joining together the first blocking portion and the second blocking portion, the second wall of the second shell being disposed inside or outside of the second wall of the cover, the first wall of the cover and the first wall of the second shell constitute the wall on the one side in the third direction of the composite tube, and the second wall of the cover and the second wall of the second shell constitute the wall on the other side in the third direction of the composite tube.

10. The connector according to claim 6, wherein the second shell includes:

a first wall joining together the first blocking portion and the second blocking portion, the first wall of the second shell being disposed inside or outside of the first wall of the cover; and a second wall joining together the first blocking portion and the second blocking portion, the second wall of the second shell being disposed inside or outside of the second wall of the cover, the first wall of the cover and the first wall of the second shell constitute the wall on the one side in the first direction of the composite tube, and the second wall of the cover and the second wall of the second shell constitute the wall on the other side in the first direction of the composite tube.

11. The connector according to claim 5, wherein the connecting portion of the first shell includes:

a first portion being a portion on one side in the second direction of the connecting portion; and a second portion being a portion on the other side in the second direction of the connecting portion, the cover extends in the first direction contiguously from the first portion of the connecting portion, the first and second walls of the cover are opposed to the second portion of the connecting portion, with interstices left between the first and second walls and the second portion, and the first blocking portion of the second shell blocks the interstice between the second portion of the connecting portion and the first wall of the cover and the interstice between the second portion of the connecting portion and the second wall of the cover.

12. The connector according to claim 11, wherein the first blocking portion of the second shell fits in between the second portion of the connecting portion and the first wall of the cover, and between the second portion of the connecting portion and the second wall of the cover.

13. The connector according to claim 5, wherein the first blocking portion of the second shell is fixed to the body.

14. The connector according to claim 9, wherein the first wall of the second shell is in surface contact with the first wall of the cover, and the second wall of the second shell is in surface contact with the second wall of the cover.

15. The connector according to claim 14, wherein the first and second walls of the cover are provided with a first engaging portion, the first and second walls of the second shell are provided with a second engaging portion, the first engaging portion is an engaging protrusion and the second engaging portion is an engaging recess or engaging hole, or alternatively the second engaging portions is an engaging protrusion and the first engaging portions is an engaging recess or engaging hole, and the engaging protrusion is configured to engage with the engaging recess or engaging hole.

16. The connector according to claim 14, wherein the first wall of the second shell is in surface contact with the first wall of the cover from inside the first wall of the cover, the second wall of the second shell is in surface contact with the second wall of the cover from inside the second wall of the cover, and the first shell further includes a leg extending from the first wall of the first shell and a leg extending from the second wall of the first shell.

17. A connector comprising:

a shield case including a first shell and a second shell, the first shell including:

a connecting portion of tuboid shape extending in a first direction, and a coupling portion extending in the first direction contiguously from the connecting portion, wherein the second shell is a separate member from the first shell and attached to the coupling portion, the second shell is of tuboid shape extending in a second direction or an oblique direction, the second direction is orthogonal to the first direction, and the oblique direction includes components of the first and second directions;

a body having an insulating property and being housed in the shield case; and a terminal held by the body and housed in the shield case, the terminal including:

a first portion extending in the first direction and being disposed inside the connecting portion, and a second portion extending in the second direction or the oblique direction and being disposed inside the second shell.

18. The connector according to claim 17, wherein the first portion of the terminal is disposed inside the connecting portion such as to extend along a central axis of the connecting portion, distances L1 , L2, L3', and L4' are set such as to provide matched impedances between the first portion and the second portion of the terminal, the distance L1 is a distance to one side in the second direction, from the first portion of the terminal to the connecting portion, the distance L2 is a distance to the other side in the second direction, from the first portion of the terminal to the connecting portion, the distance L3' is a distance to one side in the first direction, from the second portion of the terminal to the second shell, and the distance L4' is a distance to the other side in the first direction, from the second portion of the terminal to the second shell.

19. The connector according to claim 17, wherein the first portion of the terminal is disposed in the connecting portion such as to extend along a central axis of the connecting portion, distances L5, L6, L7', and L8' are set such as to provide matched impedances between the first portion and the second portion of the terminal, the distance L5 is a distance to one side in the third direction, from the first portion of the terminal to the connecting portion, the distance L6 is a distance to the other side in the third direction, from the first portion of the terminal to the connecting portion, the distance L7' is a distance to the one side in the third direction, from the second portion of the terminal to the second shell, the distance L8' is a distance to the other side in the third direction, from the second portion of the terminal to the second shell, and the third direction is orthogonal to the first direction and the second direction.

20. The connector according to claim 17, wherein the coupling portion of the first shell has an engaging hole, the second shell includes:

an engaging piece configured to be engaged with the engaging hole; and a main body configured to block the engaging hole.

21. The connector according to claim 4, further comprising a case having an insulating property, the case is configured to house the shield case and has an engaging hole, the engaging hole of the case communicating with the engaging hole of the first shell, and the engaging piece of the second shell is engaged with the engaging hole of the first shell and the engaging hole of the case.

22. The connector according to claim 17, wherein the second shell comprises:

a wall on one side in the first direction;

a wall on other side in the first direction;

a wall on one side in a third direction, the third direction being orthogonal to the first and second directions; and a wall on other side in the third direction.

* * * * *